US005720582A

United States Patent [19]

Morrison et al.

[11] Patent Number: 5,720,582

[45] Date of Patent: Feb. 24, 1998

[54] BOLT DELIVERY SYSTEM WITH LINEAR BOLT MAGAZINE

[75] Inventors: Ward D. Morrison; Perry L. Coombs, both of Claremont, N.H.

[73] Assignee: Cannon Industries, Inc., Claremont, N.H.

[21] Appl. No.: 673,738

[22] Filed: Jun. 27, 1996

[51] Int. Cl.[6] ..... E21D 20/00

[52] U.S. Cl. ..... 405/303; 405/259.1; 29/809; 81/57.37

[58] Field of Search ..... 405/303, 259.1, 405/259.6; 29/809, 810, 812.5, 813; 81/55, 57.37

[56] References Cited

U.S. PATENT DOCUMENTS

| | | | |
|---|---|---|---|
| 3,218,893 | 11/1965 | Madison et al. | 81/55 |
| 4,229,124 | 10/1980 | Frey et al. | 405/303 |
| 4,398,850 | 8/1983 | Talvensaari | 405/303 X |
| 4,420,277 | 12/1983 | Hibbard et al. | 405/303 X |
| 4,473,325 | 9/1984 | Beney et al. | 405/303 |
| 4,832,536 | 5/1989 | Spross et al. | 405/303 |
| 5,114,279 | 5/1992 | Bjerngren et al. | 405/303 |
| 5,556,235 | 9/1996 | Morrison et al. | 405/303 |
| 5,597,267 | 1/1997 | Morrison et al. | 405/303 |

*Primary Examiner*—Tamara L. Graysay
*Assistant Examiner*—Frederick L. Lagman
*Attorney, Agent, or Firm*—Michael J. Weins

[57] ABSTRACT

The present invention provides a bolt delivery system having a bolt magazine movably attached to a magazine base which in turn is affixed to a rock bolter having a bolt driver. The bolt magazine moves between a work position and a park position. In its work position, a linear incremental bolt advancing mechanism advances the bolts to where they are aligned with the bolt driver, and, in combination with a bolt-embracing arm, maintains the aligned bolt until it is engaged by the bolt driver. After the bolt driver has engaged the bolt and advanced it to engage a bolt centralizer provided to position the bolt in a pre-drilled hole in a rock surface, the bolt magazine is moved to its park position. At which time, the bolt driver is further advanced driving the bolt into the pre-drilled hole. The linear incremental bolt advancing mechanism preferably has a lower and an upper bolt advancing mechanism, and more preferably, provides the bolts a component of motion toward the rock surface. Preferably, the bolt delivery system also delivers bolt plates.

22 Claims, 10 Drawing Sheets

BOLT DELIVERY SYSTEM WITH LINEAR BOLT MAGAZINE

FIELD OF THE INVENTION

The present invention relates to a rock bolter and particularly to a rock bolt delivery system.

BACKGROUND OF THE INVENTION

There are a variety of rock bolt delivery systems currently available for rock bolters which employ a rock bolt magazine to allow several rock bolts to be stored before being individually advanced to a bolt transfer mechanism which in turn places the bolt engaged therein into alignment with a bolt driver which in turn is aligned with a bolt hole into which the bolt is to be set. U.S. Pat. No. 4,226,559 teaches one such transfer mechanism.

Applicants, in co-pending U.S. patent application Ser. No. 08/590,498, now U.S. Pat. No. 5,597,267, which is a division of application Ser. No. 08/390,746, now U.S. Pat. No. 5,556,235, which is a continuation-in-part of application Ser. No. 08/140,299 (now abandoned), disclosed a rock bolt magazine having a bolt transfer axis which can be swung into alignment with a centralizer which locates the bolt hole. The bolt magazine of the '746 application eliminates the need for a separate bolt transfer mechanism. This is accomplished by providing a bolt magazine which carries multiple bolts and individually advances them such that one of the bolts will reside on a magazine bolt transfer axis. The bolt magazine pivots with respect to a feed shell along which rock setting tools are advanced. The bolt magazine pivots from a park position, where the bolt magazine is positioned such that the rock setting tools will pass thereby, to a work position, where the bolt magazine intersects the path of a bolt driver. The bolt driver has a bolt driver axis which is parallel to the feed shell. When the bolt magazine is in the work position, the bolt driver is positioned to be advanced on the feed shell, the bolt driver axis and a bolt centralizer through which the bolt will pass are aligned, and the bolt driver axis is coincident with the bolt transfer axis of the bolt magazine. The bolt centralizer is provided to assist in directing the bolt into the bolt hole into which the bolt is to be set. When the bolt magazine is in the work position, since the bolt driver axis is collinear with the bolt transfer axis of the bolt magazine and with the bolt centralizer, the bolt driver will direct the bolt into the bolt centralizer and into the bolt hole associated therewith as the bolt driver is advanced.

The bolt magazine of the '746 application employs either a circular path or an oval path for advancement of the bolts in the bolt magazine to the bolt transfer axis. These circular and oval paths result in bolt magazines which have large cross sections and substantially obstruct the view of the operator of the rock bolter.

Furthermore, the bolt magazines of the '746 patent application advance the bolts toward the feed shell by gripping each of the bolts at two locations with fingers or clips which move in paths normal to the feed shell. Such paths for the clips or fingers result in all the bolts carried by the bolt magazine being in close proximity to the surface into which the bolts are to be set. Having all bolts in the bolt magazine in close proximity to the rock surface requires the region of the rock surface in the vicinity of the bolt hole to be substantially planar to allow the bolt magazine to be swung into and out of the work position.

This requirement of having all the bolts in close proximity to the rock surface has in part been overcome in the '746 application by providing a rub rail on which the heads of the bolts ride. The rub rail is inclined with respect to the feed shell and provides a component of motion to the bolts in the direction of the rock surface as they are advanced to the bolt transfer axis. While this solution will serve to advance the bolts toward the rock surface, it requires applying forces to the bolts in non-parallel directions and can subject the bolts to bending and can result in jamming of the bolt magazine.

Thus there is a need for a bolt delivery system employing a bolt magazine having a smaller cross section which can advance a bolt towards the rock surface into which the bolts are to be set without introducing forces which can contribute to bending of the bolt or jamming of the bolt magazine.

OBJECTS OF THE INVENTION

It is an object of the invention to provide a bolt magazine which will advance a bolt to a position where the bolt is aligned with an axis of a bolt driver.

It is another object of the invention to provide a bolt magazine with a relatively small cross section to provide better visibility for the operator.

It is still another object of the invention to provide a bolt magazine in which, as the bolts are advanced to a position where they can be aligned with the bolt driver, the bolts will also be advanced toward the rock surface into which they are to be set.

It is still another object of the invention to provide a bolt magazine which rotates from a park position to a work position and where the footprint swept out by the stored bolts in a plane in close proximity to the rock surface is small.

It is still another object of the invention to provide a bolt magazine which can be advanced towards the rock surface which does not require the bolt magazine to be swung into position.

It is a further object of the invention to provide a bolt magazine which has bolt advancing mechanisms which translate the bolts in a path that has a component of motion toward the surface into which the bolts are to be set.

It is a further object of the invention to provide a bolt magazine which supports the bolts housed therein in all positions, including positions where the bolts have a downward inclination.

SUMMARY OF THE INVENTION

The present invention provides a bolt delivery system for a rock bolter. The bolt delivery system both feeds rock bolts and positions them for setting into predrilled holes in a rock surface. The bolts terminate at one end in a bolt head configured to engage a bolt driver and at the other end in a bolt tip configured to be insertable into a predrilled bolt hole. The bolt delivery system is connected to a feed shell of the rock bolter. The feed shell directs the bolt driver, as well as other bolt setting tools, therealong. The bolt driver has a bolt driver axis. When the bolt driver is positioned to be advanced along the feed shell, the bolt driver axis is aligned with a bolt centralizer which in turn is aligned with a pre-drilled bolt hole in the rock surface. Preferably, the bolt delivery system also has the capacity to deliver bolt plates which are employed to stabilize the rock surface into which the bolts are set.

The present invention provides a bolt delivery system which has a bolt magazine and an associated magazine base. The bolt magazine has a magazine frame and is provided with a linear incremental bolt advancing mechanism which advances the bolts to a bolt transfer axis. The bolt transfer axis is alignable with the bolt driver axis.

The magazine base is fixably positioned with respect to the feed shell. The magazine frame is movably attached to the magazine base such that the bolt magazine can be moved between a park position and a work position. When the bolt magazine is in the park position, the bolt setting tools can be advanced along the feed shell without engaging the bolt magazine. When the bolt magazine is in the work position and the bolt driver is positioned on the feed shell, both the bolt transfer axis of the bolt magazine and the bolt positioned on the bolt transfer axis align with the bolt driver axis and the bolt centralizer. When the bolt is so aligned, the bolt driver will engage the bolt and advance the bolt into the bolt centralizer as the bolt driver is advanced.

A first bolt-embracing arm is provided which, in combination with the linear incremental bolt advancing mechanism, maintains the bolt that has been advanced to the bolt transfer axis in position. The first bolt-embracing arm is pivotably mounted with respect to the magazine frame and is biassed by an arm biassing spring towards a bolt-engaging position. After the bolt on the bolt transfer axis is engaged by the bolt driver and advanced into engagement with the bolt centralizer of the rock bolter, the bolt magazine is moved from the work position to the park position. The engagement of the bolt with the bolt driver and the bolt centralizer prevents any non-axial motion of the bolt. As the bolt magazine is moved from the work position, the first bolt-embracing arm is forced against the bias of the arm biassing spring to a bolt-passing position which allows the first bolt-embracing arm to slide past the bolt, allowing the bolt to be disengaged from the bolt magazine.

Means for moving the bolt magazine between the work position and the park position are provided. When the bolt magazine is in the work position, the bolt driver is advanced until it engages the bolt on the bolt transfer axis. The bolt driver is then further advanced until the bolt engages the bolt centralizer. When the bolt is so engaged, it is supported by the bolt driver and the bolt centralizer and the bolt magazine is moved to the park position, disengaging the bolt from the bolt magazine. Once the bolt magazine has been moved to the park position, the bolt driver can be further advanced along the feed shell, advancing the bolt through the bolt centralizer and into the pre-drilled hole into which it is to be set.

The linear incremental bolt advancing mechanism preferably has both a lower bolt advancing mechanism and an upper bolt advancing mechanism. It should be noted that the terms "upper" and "lower" are defined as if the bolt magazine is positioned to maintain the bolts with an upward inclination, thus the lower bolt advancing mechanism engages the bolts at a location closer to the bolt heads than the location at which the upper bolt advancing mechanism engages the bolts.

The lower bolt advancing mechanism has a lower bolt retainer and a bolt restraint rail which are mounted to the magazine frame of the bolt magazine. The bolt restraint rail is positioned in a spaced apart relationship with respect to the lower bolt retainer such that a separation distance between the bolt restraint rail and the lower bolt retainer will maintain engagement of the bolts with both the bolt restraint rail and the lower bolt retainer.

Lower bolt retaining notches are provided which locally increase the separation between the bolt restraint rail and the lower bolt retainer to provide bolt rest positions which are periodically spaced at a distance d. The lower bolt retaining notches are configured with a depth sufficient to provide lateral support for the bolts while maintaining engagement of the bolts with both the lower bolt retainer and the bolt restraint rail.

To allow the bolts to be passed from one lower bolt retaining notch to an adjacent lower bolt retaining notch closer to the bolt transfer axis, means for accommodating a variable separation distance between the lower bolt retainer and the bolt restraint rail are provided. It is preferred that means for accommodating a variable separation be by .resiliently mounting the lower bolt retainer to the magazine frame such that it is biassed towards the bolt restraint rail. It is also preferred that the lower bolt retaining notches be provided in the lower bolt retainer rather than in the bolt restraint rail.

The lower bolt advancing mechanism also has a lower bolt carrier having lower carrier bolt engaging surfaces. Means are provided for driving the lower bolt carrier through a lower carrier bolt advancing cycle. Preferably, the lower carrier bolt advancing cycle has four segments. In the first segment, the lower bolt carrier is moved from a non-bolt-contacting position to a position where the lower carrier bolt engaging surfaces engage the bolts. The second segment advances the lower bolt carrier toward the feed shell, advancing the bolts the separation distance d of the periodic lower bolt retaining notches to transfer the bolts from one lower bolt retaining notch to an adjacent lower bolt retaining notch closer to the bolt transfer axis. The third segment of the lower carrier bolt advancing cycle disengages the lower carrier bolt engaging surfaces from the bolts. The fourth segment retracts the lower bolt carrier away from the feed shell, returning it to the non-bolt-contacting position. The lower carrier bolt advancing cycle can be initiated from either the beginning of the first segment of the cycle, when the bolt transfer axis is to be bolt-free until the cycle is started, or alternatively from the beginning of the third segment, when the additional support of the lower bolt carrier for the bolt positioned on the bolt transfer axis is desired. The lower carrier bolt advancing cycle can be activated by the operator either when the bolt magazine is in the park position or in the work position.

The upper bolt advancing mechanism has an upper bolt retainer, which is mounted to the magazine frame of the bolt magazine, and a bolt-engaging edge, which is mounted in a spaced apart relationship from the upper bolt retainer such that a separation distance between the bolt-engaging edge and the upper bolt retainer will maintain engagement of the bolts with both the bolt-engaging edge and the upper bolt retainer. Preferably, the bolt magazine is fitted with an end cap, which is spaced apart from the bolt tips and serves to prevent debris from the bolt setting operations from falling into the bolt magazine when bolts are to be set into an overhead rock surface. When an end cap is employed, the bolt-engaging edge is preferably attached thereto.

Upper bolt retaining notches are provided which locally increase the separation between the bolt-engaging edge and the upper bolt retainer to provide bolt rest positions which are periodically spaced at the distance d. The upper bolt retaining notches are configured with a depth sufficient to provide lateral support for the bolts while maintaining engagement of the bolts with the upper bolt retainer and the bolt-engaging edge. The upper bolt retaining notches, in combination with the lower bolt retaining notches, maintain the bolts in a linear array which defines a bolt delivery plane.

To allow the bolts to be passed from one upper bolt retaining notch to an adjacent upper bolt retaining notch closer to the bolt transfer axis, means for accommodating a variable separation distance between the upper bolt retainer and the bolt-engaging edge are provided. It is preferred that means for accommodating a variable separation be by resiliently mounting the upper bolt retainer to the magazine frame such that it is biassed towards the bolt-engaging edge. It is also preferred that the upper bolt retaining notches be provided in the upper bolt retainer rather than in the bolt-engaging edge.

The upper bolt advancing mechanism also has an upper bolt carrier having upper carrier bolt engaging surfaces. Means are provided for driving the upper bolt carrier through an upper carrier bolt advancing cycle. Preferably, the upper carrier bolt advancing cycle has four segments. In the first segment, the upper bolt carrier is moved from a non-bolt-contacting position to a position where the upper carrier bolt engaging surfaces engage the bolts. The second segment advances the upper bolt carrier toward the feed shell, advancing the bolts the separation distance d of the periodic upper bolt retaining notches, transferring the bolts from one upper bolt retaining notch to an adjacent upper bolt retaining notch closer to the bolt transfer axis. The third segment of the upper carrier bolt advancing cycle disengages the upper carrier bolt engaging surfaces from the bolts. The fourth segment retracts the upper bolt carrier away from the feed shell, returning it to the non-bolt-contacting position. The upper carrier bolt advancing cycle is activated concurrently with the lower carrier bolt advancing cycle. When the lower carrier bolt advancing cycle is initiated from the beginning of its first segment, the upper carrier bolt advancing cycle is initiated from the beginning of the first segment of its cycle. Alternatively, when the lower bolt advancing cycle initiates from the beginning of its third segment, the upper carrier bolt advancing cycle initiates from the beginning of its third segment.

When the linear incremental bolt advancing mechanism has a lower bolt advancing mechanism and upper bolt advancing mechanism, it is preferred to employ not only the first bolt-engaging arm but to also provide a second bolt-embracing arm. When a second bolt-embracing arm is employed, the second bolt-embracing arm works in combination with the upper bolt advancing mechanism to maintain a bolt which has been advanced to the bolt transfer axis in position, while the first bolt-embracing arm works in combination with the lower bolt advancing mechanism to maintain a bolt which has been advanced to the bolt transfer axis in position.

Preferably, means are provided for stopping the advancement of the bolt driver prior to its engagement of the bolt magazine. These means prevent damage to the bolt magazine or the magazine base by stopping the advancement of the bolt driver until the operator has activated the means for moving the bolt magazine between the work position and the park position to return the bolt magazine to the park position.

A bolt head support rail is preferably provided for additional support for the bolts when the bolt magazine has the bolts positioned for placement into an overhead rock surface. The bolt head support rail is affixed with respect to the magazine frame. When the linear incremental bolt advancing mechanism has a lower bolt advancing mechanism, the bolt head support rail is positioned such that it is substantially parallel to the lower bolt advancing mechanism. However, there may be a slight divergence from the lower bolt advancing mechanism such that the separation between the bolt head support rail and the lower bolt advancing mechanism is greatest near the bolt transfer axis. Such a divergence will reduce friction between the bolts and the bolt head support rail, as the divergent angle of the lower bolt advancing mechanism will tend to pull the bolt heads away from engagement with the bolt head support rail as they are advanced toward the bolt transfer axis. Preferably the bolt head support rail has a bolt head restraining lip to support the bolt heads when the bolt magazine has the bolts positioned for placement with a downward inclination or into a rock floor surface.

It is further preferred that the lower bolt advancing mechanism and the upper bolt advancing mechanism are positioned such that they provide the bolts a component of motion which is toward the rock surface as the bolts are advanced toward the bolt transfer axis.

In one preferred embodiment, the bolt magazine is pivotably mounted to the magazine base, while in another preferred embodiment, the bolt magazine is slidably engaged with the magazine base.

The bolt magazine of the present invention can also serve as a combination bolt and bolt plate magazine. In this case, the bolts and bolt plates are loaded into the bolt magazine, each bolt passing through its associated bolt plate. A first bolt plate support rail is mounted to the magazine frame and positioned in close proximity to the bolts so as to provide support to the bolt plates. Preferably, both a first bolt plate support rail and a second bolt plate support rail are employed, the first bolt plate support rail and the second bolt plate support rail being positioned such that the bolt plates reside therebetween.

When the lower bolt advancing mechanism and the upper bolt advancing mechanism provide a component of motion to the bolts which is toward the rock surface, it is preferred for the first and second bolt plate support rails to have first and second rail angled portions, respectively, to facilitate loading the bolts and bolt plates such that the bolt plates can overlap.

BRIEF DESCRIPTION OF FIGURES

FIG. 2 also illustrates the connection of a hydraulic cylinder to the bolt magazine and a magazine base. The hydraulic cylinder provides a pivoting motion between the magazine base and the bolt magazine. The bolt magazine is pivotably attached to the magazine base which in turn is affixed to the feed shell.

BEST MODE FOR CARRYING THE INVENTION INTO PRACTICE

Figure 1:
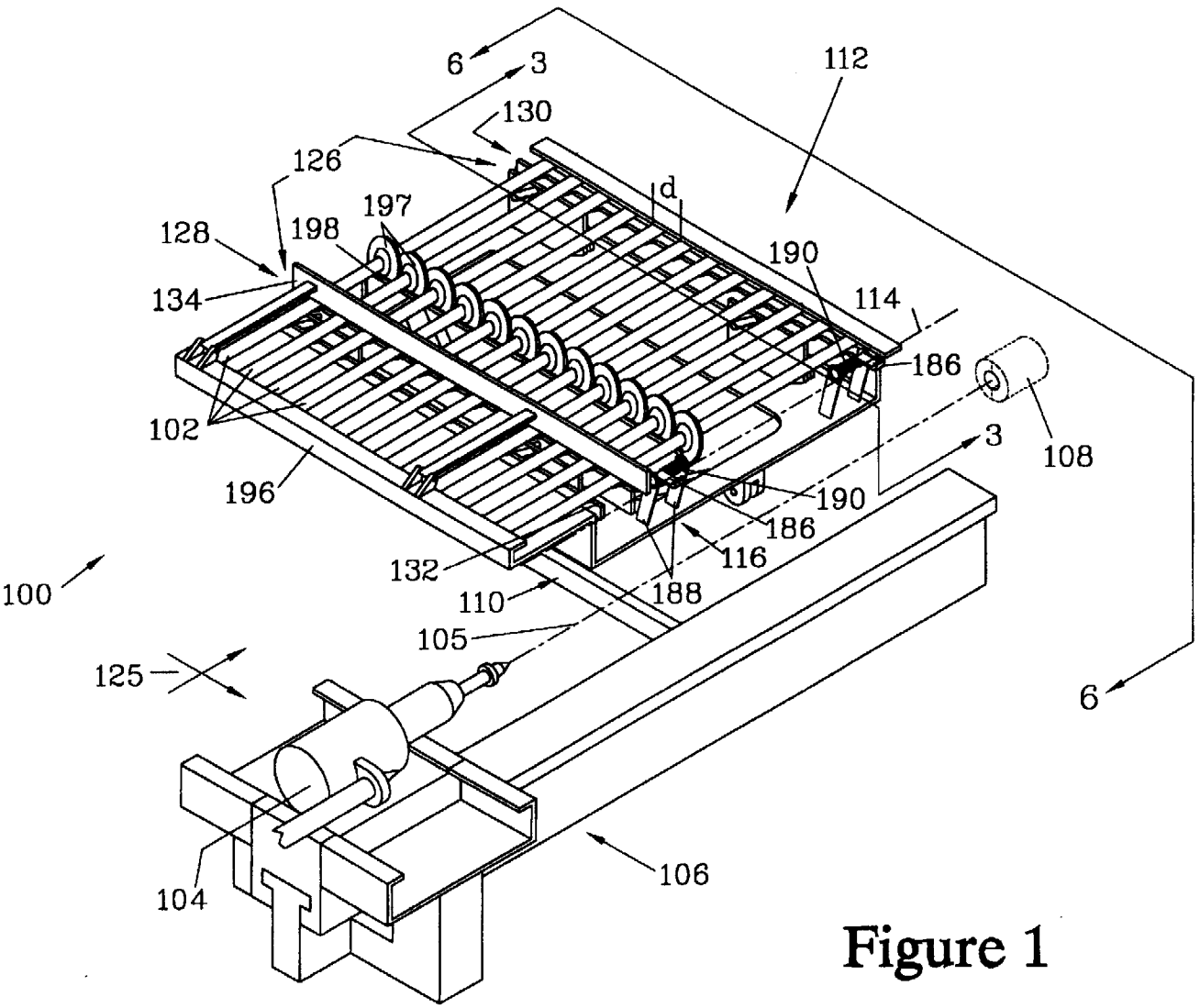
FIG. 1 is an isometric view of a bolt delivery system employing a linear bolt magazine. The bolt magazine is shown in a park position where it is positioned such that bolt setting tools can be advanced along a feed shell of the rock bolter without engaging the bolt magazine.
Figure 2:
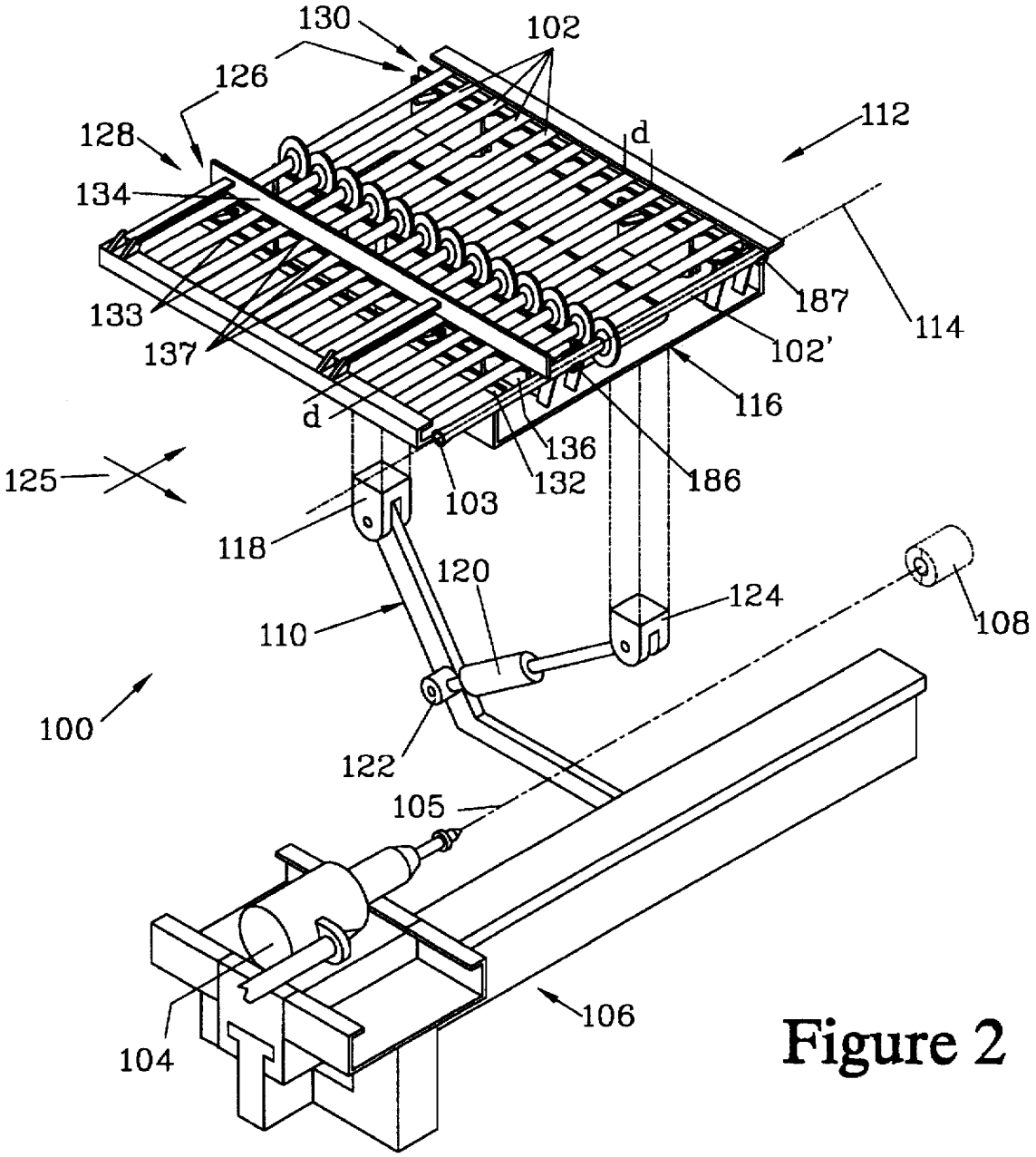
FIG. 2 is a partially exploded view of FIG. 1 where one of the bolts has been advanced to a bolt transfer axis of the bolt magazine.

FIGS. 1 and 2 are two isometric views of one embodiment of a bolt delivery system 100 of the present invention, FIG. 2 being partially exploded. FIGS. 1 and 2 illustrate an embodiment of the bolt delivery system 100 which feeds bolts 102, having bolt heads 103 (one of which is shown in FIG. 2) and bolt tips (not shown), to a rock bolter such as described and illustrated in U.S. patent application Ser. No. 08/390,746, now U.S. Pat. No. 5,556,235, and incorporated herein by reference. Such a rock bolter typically employs a bolt driver 104, having a bolt driver axis 105, and a feed shell 106, along which the bolt driver 104 can be advanced. A bolt centralizer 108 (shown in phantom) is provided which is aligned with a hole drilled in a rock surface (not shown) into which a bolt 102' is to be set. The bolt centralizer 108 is aligned with the bolt driver axis 105.

The bolt delivery system 100 has a magazine base 110 which is attached to the feed shell 106 and a bolt magazine 112 which houses the bolts 102. The bolt magazine 112 has a bolt transfer axis 114 onto which the bolts 102 are advanced in preparation to being set.

The bolt magazine 112 has a magazine frame 116 which is pivotably attached to the magazine base 110 with a base bracket 118 (shown in FIG. 2). The base bracket 118 pivotably attaches to the magazine base 110 and is fixably attached to the magazine frame 116. It should be appreciated that the base bracket 118 could alternatively be affixed to the magazine base 110 and pivotably connected with respect to the magazine frame 116.

Figure 6:
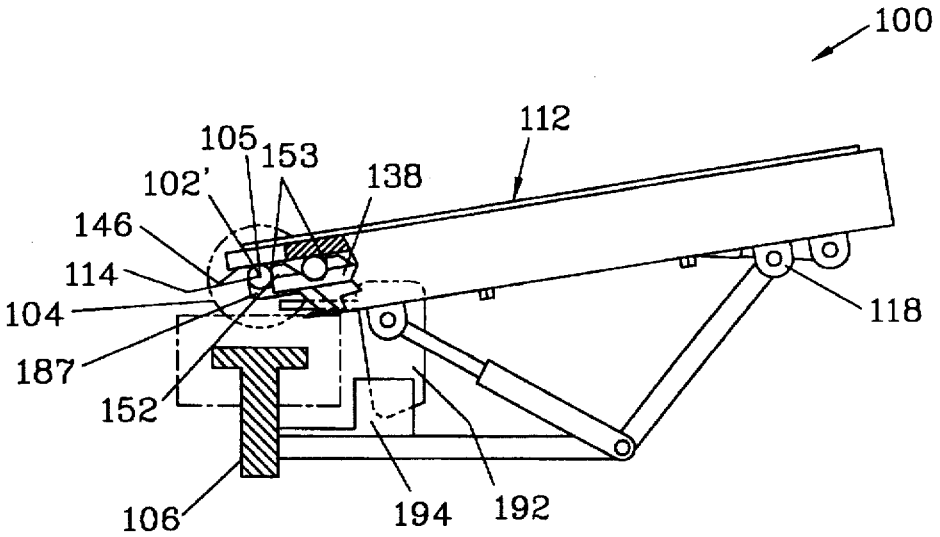
FIG. 6 is a view from plane 6-6 of FIG. 1 where the bolt magazine is in a work position where a bolt is positioned to be engaged by a bolt driver.
Figure 7:
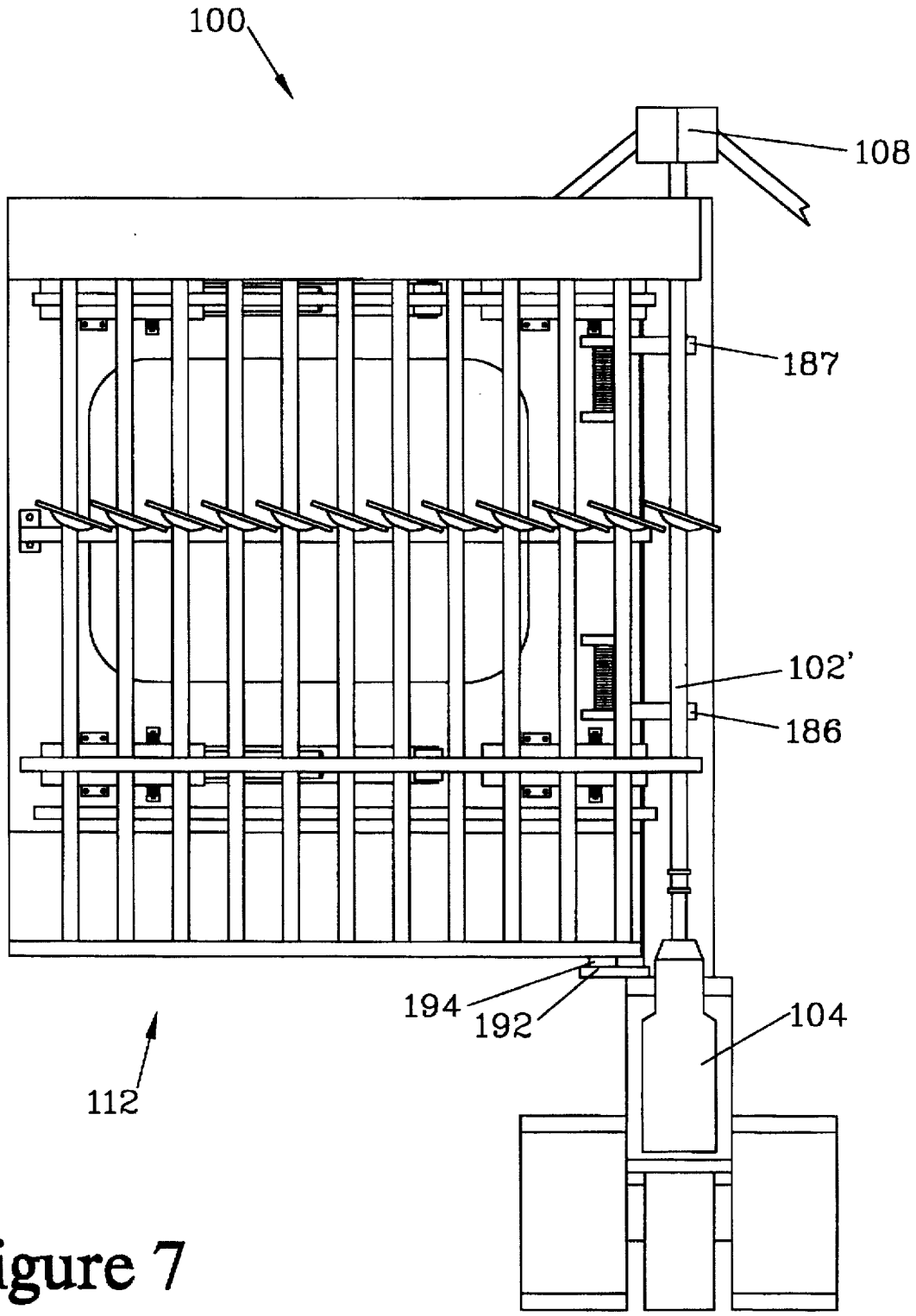
FIG. 7 is a plan view of the embodiment of FIG. 1 when the bolt magazine is in the work position illustrated in FIG. 6. The bolt which is on the bolt transfer axis of the bolt magazine has been engaged by the bolt driver and advanced into a bolt centralizer.

A linear actuator 120, which in this embodiment is a hydraulic cylinder, is employed to rotate the bolt magazine 112 between a park position (illustrated in FIGS. 1, 2, and 9) and a work position (illustrated in FIGS. 6 and 7). The linear actuator 120 is pivotably attached to the magazine base 110 with a linear actuator base bracket 122 and to the magazine frame 116 with a linear actuator frame bracket 124.

Figure 9:
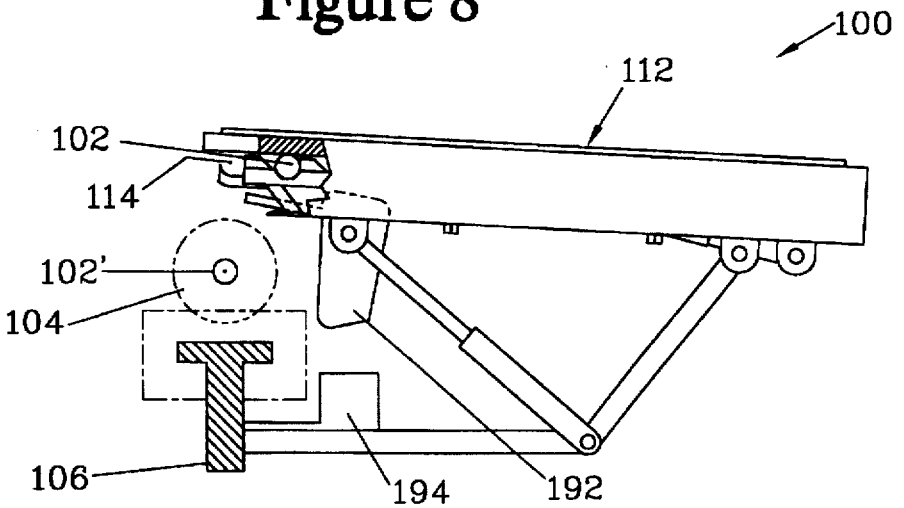
FIG. 9 is the same view as FIGS. 6 and 8 when the bolt magazine has been returned to the park position.

In the park position, the bolt magazine 112 is positioned such that the bolt driver 104 (or other bolt setting tools not shown) will pass by the bolt magazine 112 as the bolt driver 104 (or other bolt-setting tool) is advanced along the feed shell 106. (FIG. 9 illustrates the clearance between the bolt driver 104 and the bolt magazine 112 when the bolt magazine 112 is in its park position.)

In the work position, the bolt magazine 112 is positioned such that the bolt transfer axis 114 of the bolt magazine 112 aligns with the bolt driver axis 105 of the bolt driver 104 (as is illustrated in FIG. 6) and with the bolt centralizer 108. When the bolt magazine 112 is in the work position, the bolt 102' (shown in FIG. 2) which is on the bolt transfer axis 114 will be engaged by the bolt driver 104 as the bolt driver 104 is advanced along the feed shell 106.

The bolt magazine 112 carries the bolts 102 in a linear array such that the bolts 102 lie in a bolt delivery plane 125 and are advanced in the bolt delivery plane 125 to the bolt transfer axis 114 by a linear incremental bolt advancing mechanism 126. In the embodiment of FIG. 1, the linear incremental bolt advancing mechanism 126 is provided by a lower bolt advancing mechanism 128 and an upper bolt advancing mechanism 130. The lower bolt advancing mechanism 128 engages the bolts 102 at a location closer to the bolt heads 103 than the location at which the upper bolt advancing mechanism 130 engages the bolts 102, and the separation between the lower bolt advancing mechanism 128 and the upper bolt advancing mechanism 130 should be sufficiently large to adequately stabilize the bolts 102 and maintain them in the bolt delivery plane 125. It should be noted that the bolts 102 may be advanced to the bolt transfer axis 114 irrespective of whether the bolt magazine 112 is in its park position or its work position.

The lower bolt advancing mechanism 128 has a lower bolt retainer 132 (shown in FIG. 2) which is resiliently mounted on the magazine frame 116. The lower bolt retainer 132 has a series of lower bolt retaining notches 133 periodically spaced at a distance d, which is the distance between the bolts 102. The lower bolt retainer 132 assists in maintaining the bolts 102 in a spaced apart relationship. The lower bolt retaining notches 133 are provided to locally increase the separation between the lower bolt retainer 132 and a bolt restraint rail 134. The lower bolt retaining notches 133 are configured with a depth sufficient to provide lateral support for the bolts 102 while maintaining a frictional engagement of the bolts 102 between the lower bolt retainer 132 and the bolt restraint rail 134.

The bolt restraint rail 134 of the embodiment of FIG. 1 is pivotably and lockably mounted with respect to the magazine frame 116 by a restraint rail hinged brace 135. When locked into a bolt-engaging position as shown in FIGS. 1 and 2, the bolt restraint rail 134 is in a spaced apart relationship with respect to the resiliently mounted lower bolt retainer 132 and positioned to maintain the bolts 102 in the lower bolt retaining notches 133, and to assist in maintaining the bolt 102' on the bolt transfer axis 114 of the bolt magazine 112. The bolt restraint rail 134, when unlocked, pivots to a bolt-loading position (not shown) where it does not interfere with loading bolts 102 into the bolt magazine 112. To allow the bolts 102 to be transferred between lower bolt retaining notches 133, means for accommodating a variable separation between the lower bolt retainer 132 and the bolt restraint rail 134 are provided. In the present embodiment, the resilient mounting of the lower bolt retainer 132 serves as such a means and allows for increasing the separation between the lower bolt retainer 132 and the bolt restraint rail 134, allowing the bolts 102 to be advanced from the lower bolt retaining notch 133 in which they reside to an adjacent lower bolt retaining notch 133 closer to the bolt transfer axis 114. The lower bolt retaining notches 133 are contoured such that the bolts 102, as they are advanced by a lower bolt carrier 136, push the lower bolt retainer 132 against the bias of its resilient mounting to increase the separation between the lower bolt retainer 132 and the bolt restraint rail 134. It is preferred for the bolt restraint rail 134, when locked in the bolt-engaging position, to be substantially aligned with the lower bolt retainer 132. It should be appreciated that the lower bolt retaining notches 133 could alternatively be provided on the bolt restraint rail 134 rather than on the lower bolt retainer 132. It is also possible to have the lower bolt retainer 132 fixably mounted to the magazine frame 116 and the bolt restraint rail 134 resiliently mounted to the magazine frame 116.

The lower bolt carrier 136 has lower carrier bolt-engaging surfaces 137 and is coupled with the magazine frame 116 such that the lower bolt carrier 136 will be advanced through a lower carrier bolt advancing cycle. The lower carrier bolt advancing cycle begins when the lower bolt carrier 136 is raised from its initial non-bolt-contacting position to bring the lower carrier bolt-engaging surfaces 137 into engagement with the bolts 102. As the cycle continues and the lower carrier bolt-engaging surfaces 137 are engaged with the bolts 102, the lower carrier bolt engaging surfaces 137 move toward the bolt transfer axis 114, advancing each of the bolts 102 from the lower bolt retaining notch 133 in which it resides to an adjacent lower bolt retaining notch 133 in closer proximity to the bolt transfer axis 114. The last bolt 102' in the bolt magazine 112 is advanced to the bolt transfer axis 114 (where it is shown in FIG. 2). The lower carrier bolt advancing cycle continues by lowering the lower carrier bolt-engaging surfaces 137, disengaging them from the bolts 102, and thereafter returning the lower bolt carrier 136 to its initial non-bolt-contacting position. It should be appreciated that the lower carrier bolt advancing cycle could alternatively start from an initial position where the lower bolt carrier 136 is raised and the lower carrier bolt-engaging surfaces 137 are engaged with the bolts 102, providing additional support to the bolts 102, and particularly to the bolt 102'.

Figure 4:
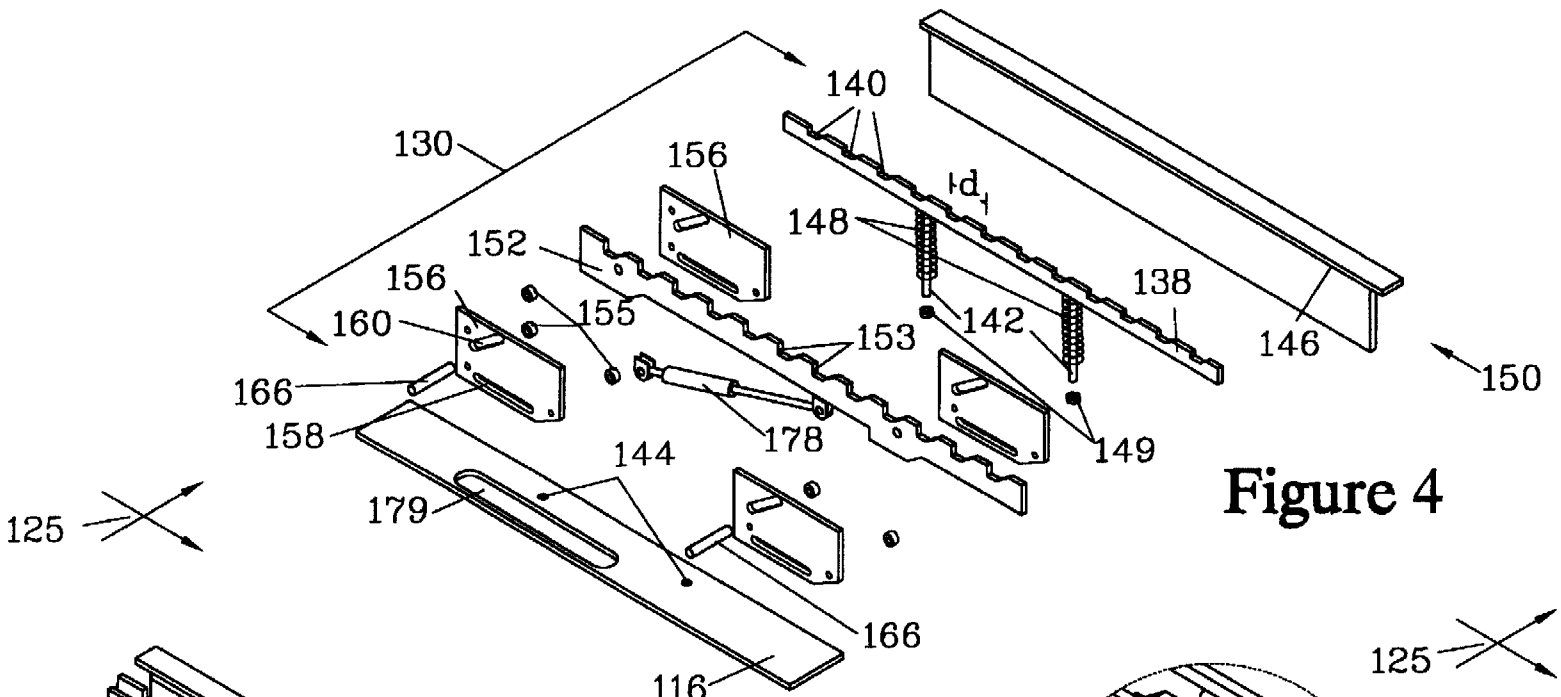
FIG. 4 is an exploded view of FIG. 3 which also shows additional elements not visible in FIG. 3.
Figure 3:
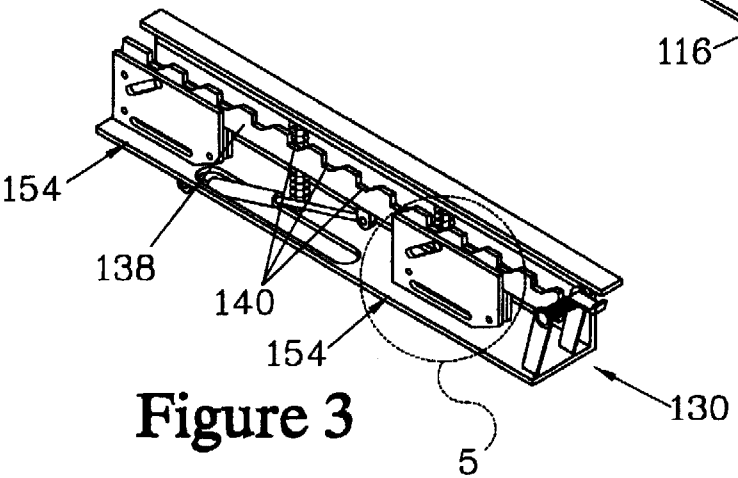
FIG. 3 is a partial isometric view from the plane 3—3 of FIG. 1, showing details of an upper bolt advancing mechanism which employs slider mechanisms having paired guide plates to provide a horizontal path and an inclined path on which an upper bolt carrier moves, supported by carrier pins.

The upper bolt advancing mechanism 130 is substantially similar to the lower bolt advancing mechanism 128. FIG. 3 illustrates a partial isometric view from a plane 3—3 of FIG. 1 looking toward the upper bolt advancing mechanism 130. FIG. 4 is an exploded view of FIG. 3. In FIGS. 3 and 4, the bolts have been removed for clarity and additional details of the structural elements of the upper bolt advancing mechanism 130 are illustrated. As with the lower bolt advancing mechanism 128, the upper bolt advancing mechanism 130 has a corresponding upper bolt retainer 138 with upper bolt retaining notches 140. The upper bolt retainer 138 is resiliently mounted on the magazine frame 116. Both the upper bolt retainer 138 and the lower bolt retainer 132 are mounted to the magazine frame 116 with retainer rods 142 which slidably engage retainer rod passages 144 in the magazine frame 116. The retainer rods 142 serve as means for accommodating a variable separation between the lower bolt retainer 132 and the bolt restraint rail 134 and between the upper bolt retainer 138 and a bolt-engaging edge 146 which is fixably mounted with respect to the magazine frame 116. The means for accommodating a variable separation allow the bolts 102 to be moved from the retaining notches (133 and 140) in which they reside to adjacent retaining notches (133 and 140). Retainer springs 148 through which the retainer rods 142 pass serve to bias the lower bolt retainer 132 toward the bolt restraint rail 134 and to bias the upper bolt retainer 138 toward the bolt-engaging edge 146. Although not shown for clarity, it should be appreciated that housings could be provided around the retainer springs 148 to prevent the accumulation of dirt and debris. The retainer rods 142 are maintained in the retainer rod passages 144 by retainer rod nuts 149.

The magazine frame 116 of the bolt magazine 112 is fitted with an end cap 150 to which is mounted the bolt-engaging edge 146. The bolt-engaging edge 146 is spaced apart from the upper bolt retainer 138 and serves to maintain the bolts 102 in the upper bolt retaining notches 140 which are again spaced at the distance d and are provided to locally increase the separation between the upper bolt retainer 138 and the bolt-engaging edge 146. The upper bolt retaining notches 140 are configured with a depth sufficient to provide lateral support for the bolts 102 while maintaining a frictional engagement of the bolts 102 between the upper bolt retainer 138 and the bolt-engaging edge 146. The upper bolt retaining notches 140 are contoured such that the bolts 102, as they are advanced by an upper bolt carrier 152, push the upper bolt retainer 138 against the bias of the retainer rod springs 148 to increase the separation between the upper bolt retainer 138 and the bolt-engaging edge 146 allowing the bolts 102 to be advanced from the upper bolt retaining notch 140 in which they reside to an adjacent upper bolt retaining notch 140. The end cap 150 is so configured that the bolt-engaging edge 146 extends over the bolt transfer axis 114 providing support to the bolt 102' located on the bolt transfer axis 114 (as shown in FIG. 6). Preferably, the bolt-engaging edge 146 is substantially aligned with the upper bolt retainer 138. Again, it should be appreciated that the upper bolt retaining notches 140 could be provided on the bolt-engaging edge 146 rather than on the upper bolt retainer 138. It is also possible to have the upper bolt retainer 138 fixably mounted to the magazine frame 116 and the bolt-engaging edge 146 resiliently mounted with respect to the magazine frame 116.

The upper bolt carrier 152 has upper carrier bolt-engaging surfaces 153 and is coupled with the magazine frame 116 such that the upper bolt carrier 152 will be advanced through an upper carrier bolt advancing cycle. The upper carrier bolt advancing cycle begins by raising the upper bolt carrier 152 from its initial non-bolt-contacting position to bring the upper carrier bolt-engaging surfaces 153 into engagement with the bolts 102. As the cycle continues, the upper carrier bolt-engaging surfaces 153 are engaged with the bolts 102 and move toward the bolt transfer axis 114, advancing each of the bolts 102 from the upper bolt retaining notch 140 in which it resides to an adjacent upper bolt retaining notch 140 in closer proximity to the bolt transfer axis 114. The last bolt 102' in the bolt magazine is advanced to the bolt transfer axis 114 (as illustrated in FIG. 2). The upper carrier bolt advancing cycle continues by lowering the upper carrier bolt-engaging surfaces 153, disengaging the upper carrier bolt-engaging surfaces 153 from the bolts 102, and thereafter returning the upper bolt carrier 152 to its initial non-bolt-contacting position. The upper carrier bolt advancing cycle is activated concurrently with the lower carrier bolt advancing cycle, and it should be appreciated that when the lower carrier bolt advancing cycle starts from an initial bolt-contacting position, the upper carrier bolt advancing cycle will also start from an initial position where the upper bolt carrier 152 is raised and the upper carrier bolt-engaging surfaces 153 are engaged with the bolts 102, again providing additional support for the bolts 102, and particularly for the bolt 102'.

In the embodiment of FIGS. 1–4 dual plate slider mechanisms 154 are employed as means for advancing the lower bolt carrier 136 through the lower carrier bolt advancing cycle, and the upper bolt carrier 152 through the upper carrier bolt advancing cycle. Each of the bolt carriers (136 and 152) is provided with a pair of slider mechanisms 154. All four of the slider mechanisms 154 are substantially the same, with the exception of different locations for spacers 155, which will be discussed below. The slider mechanisms 154 provide for motion between the slider mechanisms 154 and the magazine frame 116, this motion being parallel to the bolt delivery plane 125. The slider mechanisms 154 also provide for motion between the slider mechanisms 154 and the bolt carriers (136 and 152), this motion being inclined with respect to the bolt delivery plane 125.

Each of the slider mechanisms 154 for the embodiment of FIGS. 1–4 has a pair of guide plates 156 (as best illustrated in FIG. 4). Each guide plate 156 has a plate-directing passage 158 therethrough, which is parallel to the bolt delivery plane 125, and a carrier-directing passage 160 therethrough, which is inclined with respect to the bolt delivery plane 125. The guide plates 156 are separated by the spacers 155 which have a thickness sufficient to prevent binding between the guide plates 156 and one of the bolt carriers (136 and 152) which is mounted therebetween. The spacers 155 of each slider mechanism 154 are located so as to prevent the spacers 155 from coming into contact with the one of the bolt carriers (136 and 152) as they are advanced through their respective bolt advancing cycles.

Figure 5:
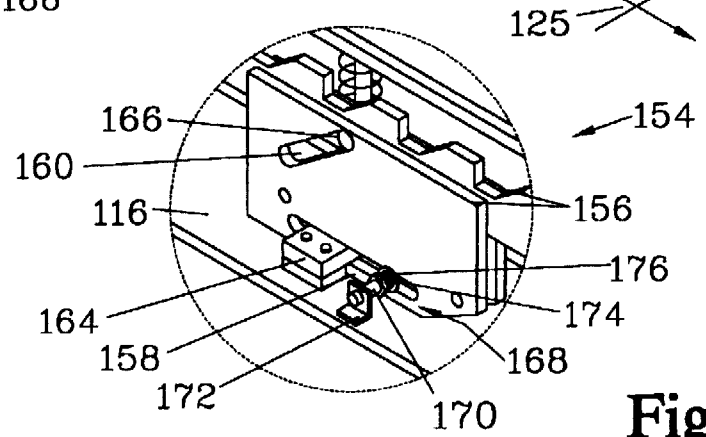
FIG. 5 is an enlarged view of region 5 of FIG. 3 which includes details not included in FIGS. 3 and 4 of one of the slider mechanisms employed in the bolt advancing mechanism illustrated in FIGS. 3 and 4. The slider mechanism provides two paths of motion, one parallel to a plane of the bolts and one inclined thereto. The slider mechanism has a pair of guide plates slidably attached to the magazine frame and a brake mechanism which engages the guide plates causing motion to first occur along the inclined path.

For each slider mechanism 154, a plate engaging stabilizing brace 164 is attached to the magazine frame 116 and slidably engages the plate-directing passages 158 as shown in FIG. 5. Bolt carrier pins 166 pass through the carrier directing passages 160 and are attached to the bolt carrier (136 or 152). Having both plate-directing passages 158 and carrier-directing passages 160 provides an action where the movement of the slider mechanisms 154 will be along a path parallel to the bolt delivery plane 125, serving to advance the bolts 102 from the bolt retaining notches (133 and 140) in which they reside towards the bolt transfer axis 114, and also provides an action where the movement of the bolt carriers (136 and 152) will be inclined with respect to the bolt delivery plane 125, allowing the bolt engaging surfaces (137 and 153) to engage the bolts 102.

To assure that the movement along the inclined path occurs before the movement along the parallel path, a brake assembly 168 is provided as partially shown in FIG. 5. The brake assembly 168 has a brake rod 170 which passes through the plate-directing passages 158. The brake rod 170 is supported by brake rod brackets 172 which are attached to the magazine frame 116. It should be appreciated that the brake rod brackets 172 could alternatively be incorporated into or mounted to the plate engaging stabilizing brace 164. Brake springs 174 are provided which bias brake washers 176 such that the brake washers 176 apply pressure to the guide plates 156 thereby forestalling motion between the guide plates 156 and the magazine frame 116 until such time as the movement between the guide plates 156 and the bolt carriers (136 and 152) is complete.

Advancing actuators 178 provide a motivating force to drive the bolt carriers (136 and 152) through their respective bolt advancing cycles. The advancing actuators 178, which in this embodiment are hydraulic cylinders, are pivotably attached to the magazine frame 116 and to each of the bolt carriers (136 and 152). The advancing actuators 178 pass through actuator slots 179 in the magazine frame 116.

The bolt delivery system 100 employs a first bolt-embracing arm 186 and a second bolt-embracing arm 187 which are pivotably mounted on the magazine frame 116 by arm brackets 188. The first bolt-embracing arm 186 and second bolt-embracing arm 187, in combination with the bolt retainers (132 and 138), the bolt restraint rail 134, and the bolt-engaging edge 146, serve to hold the bolt 102' (which has been advanced to the bolt transfer axis 114) on the bolt transfer axis 114. Arm biassing springs 190 are provided to maintain the bolt-embracing arms (186 and 187) in a bolt-engaging position. The first bolt-embracing arm 186 is positioned such that, when in its bolt engaging position, the first bolt embracing arm 186 engages the bolt 102' residing on the bolt transfer axis 114 and, in combination with the bolt restraint rail 134 and the lower bolt retainer 132, provides support to maintain the bolt 102' on the bolt transfer axis 114. The second bolt-embracing arm 187 is positioned such that, when in its bolt-engaging position, the second bolt embracing arm 187 engages the bolt 102' and, in combination with the upper bolt retainer 138 and the bolt-engaging edge 146, provides support to maintain the bolt 102' on the bolt transfer axis 114. When the lower and upper carrier bolt advancing cycles are initiated such that the bolt carriers (136 and 152) are raised when the bolt 102' resides on the bolt transfer axis 114, the bolt carriers (136 and 152) can provide support to the bolt 102' in the same manner as the bolt retainers (132 and 138). In such cases, the bolt retainers (132 and 138) need not support the bolt 102'.

FIG. 6 is a view from plane 6—6 of FIG. 1 when the bolt magazine 112 is in the work position where the bolt 102', which is on the bolt transfer axis 114, is positioned to be engaged by the bolt driver 104. FIG. 6 more fully illustrates the support provided by the second bolt embracing arm 187 to the bolt 102' when the second bolt embracing arm 187 is in its bolt-engaging position. The second bolt embracing arm 187, the upper bolt retainer 138, and the bolt-engaging edge 146 are engaged to support the front portion of the bolt 102'. When the upper bolt carrier 152 is raised as illustrated the upper carrier bolt-engaging surfaces 153 are engaged with the bolts 102, and the upper bolt carrier 152 can provide support to the bolt 102' in combination with or in place of the upper bolt retainer 138.

FIG. 7 is a plan view of the bolt delivery system 100 where the bolt magazine 112 is in the work position and where the bolt driver 104 has been advanced to engage the bolt 102' with the bolt centralizer 108. When the bolt 102' is so engaged, it is fully supported by the bolt driver 104 and the bolt centralizer 108 and any non-axial motion of the bolt 102' is prevented. At such time, the bolt magazine 112 is rotated towards the park position to disengage the bolt 102' from the bolt magazine 112. This rotating motion of the bolt magazine 112 causes the bolt embracing arms (186 and 187) to rotate against the bias of the arm biassing springs 190 (illustrated in FIGS. 1 and 2) to be moved away from their bolt-engaging positions, as illustrated in FIG. 8.

Figure 8:
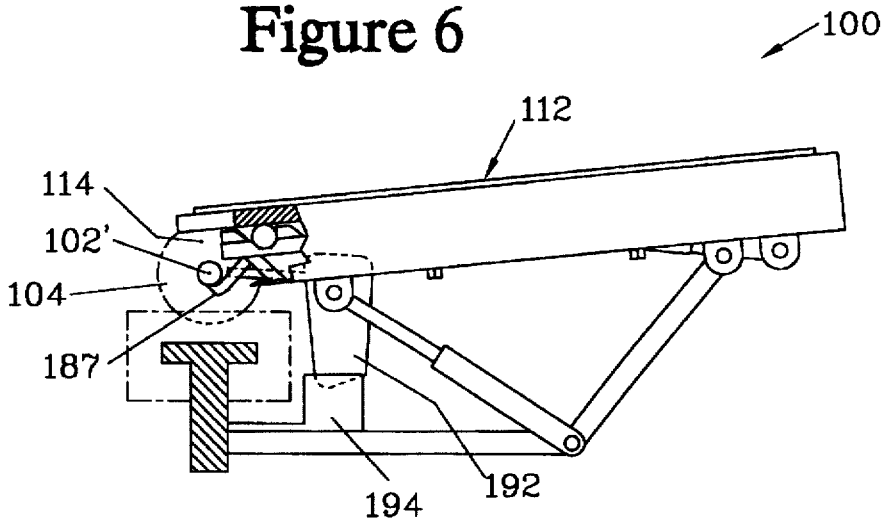
FIG. 8 is the same view from the plane 6—6 as FIG. 6; however, the bolt magazine is in an intermediate position as it is being moved from the work position to the park position. In the intermediate position of FIG. 8, a second bolt embracing arm is rotated against the bias of an arm biassing spring but has not yet reached a position where the arm will pass by the bolt.

FIG. 8 is the same view from plane 6—6 as FIG. 6; however, the bolt magazine 112 is in an intermediate position where the bolt magazine 112 is being rotated away from the work position after the bolt 102' has been engaged by the bolt driver 104 and the bolt centralizer 108 (illustrated in FIG. 7), thereby preventing any non-axial motion of the bolt 102'. The bolt embracing arms (186 and 187) are contoured such that, as the bolt magazine 112 is rotated away from the work position, the bolt embracing arms (186 and 187) are forced to rotate against the bias of the arm biassing springs 190 (illustrated in FIGS. 1 and 2) to their bolt-passing positions, where the bolt embracing arms (186 and 187) are able to slide past the bolt 102'. FIG. 8 illustrates the second bolt embracing arm 187 before it has reached its bolt-passing position. Once the bolt embracing arms (186 and 187) no longer engage the bolt 102', the arm biassing springs 190 return the bolt embracing arms (186 and 187) to their bolt-engaging positions (illustrated in FIG. 9), where they are ready to support a new bolt 102 as it is advanced to the bolt transfer axis 114.

FIG. 9 is the same view from plane 6—6 as FIGS. 6 and 8 when the bolt magazine 112 is in the park position, and shows the clearance between the bolt magazine 112 and the bolt driver 104, which allows the bolt driver 104 to be advanced along the feed shell 106 without engaging the bolt magazine 112.

Preferably, the bolt delivery system 100 also employs a stop plate 192 and a base stop support 194 (illustrated in FIGS. 6 through 9) which serve as means to stop the advancement of the bolt driver 104 prior to its engagement of the bolt magazine 112 when the bolt magazine 112 is in the work position. While such means are not essential, the stop plate 192 and base stop support 194 relieve the operator of the duty of determining when the bolt magazine 112 must be moved to the park position before the bolt driver 104 can continue to advance on the feed shell 106. The stop plate 192 is resiliently attached to the bolt magazine 112 and, when the bolt magazine 112 is in the work position (as illustrated in FIG. 6), the stop plate 192 is so positioned as to intercept the path of the bolt driver 104 as it advances along the feed shell 106 and approaches the bolt magazine 112. The stop plate 192 and the bolt magazine 112 are so positioned with respect to the bolt centralizer 108 (illustrated in FIG. 7) that when the stop plate 192 is engaged by the bolt driver 104, the bolt 102' will have entered the bolt centralizer 108. The base stop support 194 in turn is provided to avoid torsional loads on the base bracket 118 resulting from contact between the bolt driver 104 and the stop plate 192. The base stop support 194 is so configured as to allow the bolt driver 104 to pass thereby, and is only engagable with the bolt driver 104 via the stop plate 192 when the bolt magazine 112 is pivoted away from the park position (shown in FIG. 9) to the work position (shown in FIG. 6) or an intermediate position (the position shown in FIG. 8 being typical). When the bolt magazine 112 is moved to the park position (as illustrated in FIG. 9), the stop plate 192 is disengaged from the base stop support 194 and from the bolt driver 104, allowing the bolt driver 104 to continue advancing the bolt 102'.

The bolt magazine 112 is also provided with a bolt head support rail 196 (best illustrated in FIG. 1) for providing additional support to the bolt heads 103 when the rock bolter and bolt delivery system 100 are positioned for setting the bolts 102 into an overhead rock surface. The bolt head support rail 196 is attached to the magazine frame 116 and in this embodiment positioned in a parallel relationship to the lower bolt retainer 132.

In the embodiment of FIG. 1, the bolt magazine 112 also serves as a bolt plate magazine. When the bolt magazine 112 performs such a dual role, bolt plates 197 are placed on the bolts 102 prior to loading the bolts 102 into the bolt magazine 112. In the embodiment of FIG. 1, a first bolt plate support rail 198 is attached to the magazine frame 116 for stabilizing the bolt plates 197 as the bolt magazine 112 and the bolts 102 are moved.

Figure 11:
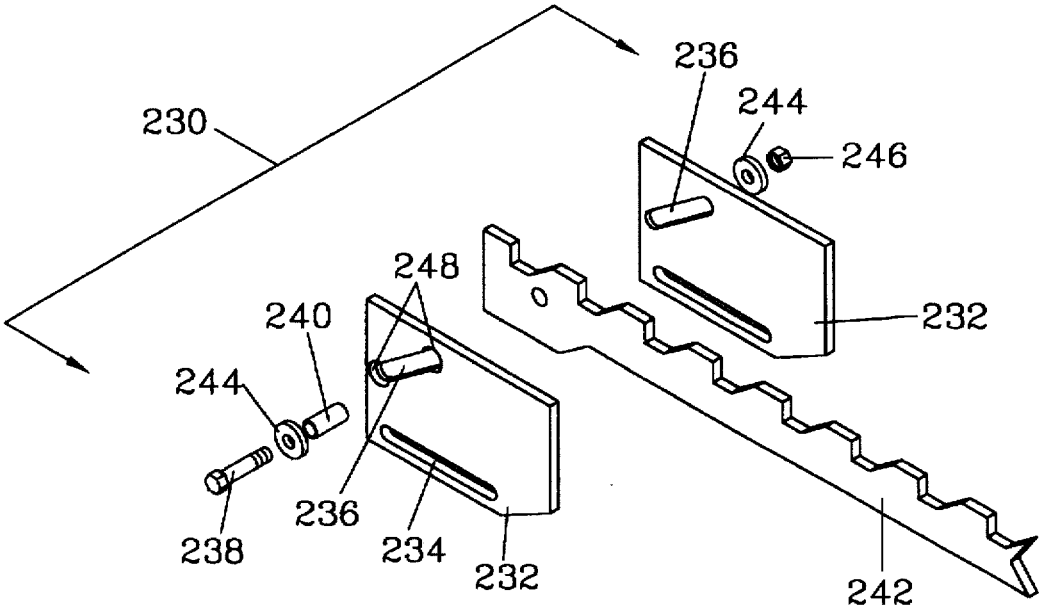
FIG. 11 is an exploded partial view of a bolt advancing mechanism similar to the bolt advancing mechanism illustrated in FIG. 3. This embodiment employs carrier bolts in combination with associated carrier bolt bushings and carrier bolt nuts to support the bolt carrier rather than carrier pins. This embodiment also employs countersunk regions in the guide plates to prevent dirt from accumulating in the inclined path.
Figure 12:
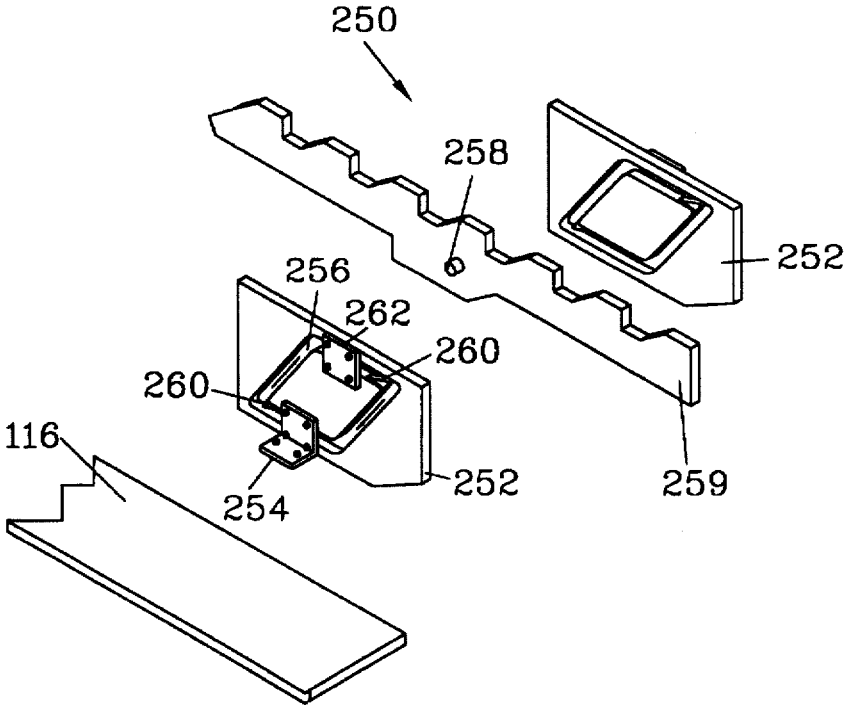
FIG. 12 is an exploded partial view of another embodiment of a bolt advancing mechanism which differs from the embodiments of FIGS. 3, 10, and 11 in that it does not employ slider mechanisms. This embodiment employs cycling mechanisms which employ parallelogram-shaped slots to provide the horizontal and inclined paths.

There are many alternative mechanisms which can be readily employed in place of the slider mechanisms 154 illustrated in FIGS. 3 through 5 to provide means for advancing the lower bolt carrier and the upper bolt carrier through their respective bolt advancing cycles. Two examples of alternative slider mechanisms are illustrated in FIGS. 10 and 11, while an alternative cycling mechanism which does not employ a slider is illustrated in FIG. 12.

Figure 10:
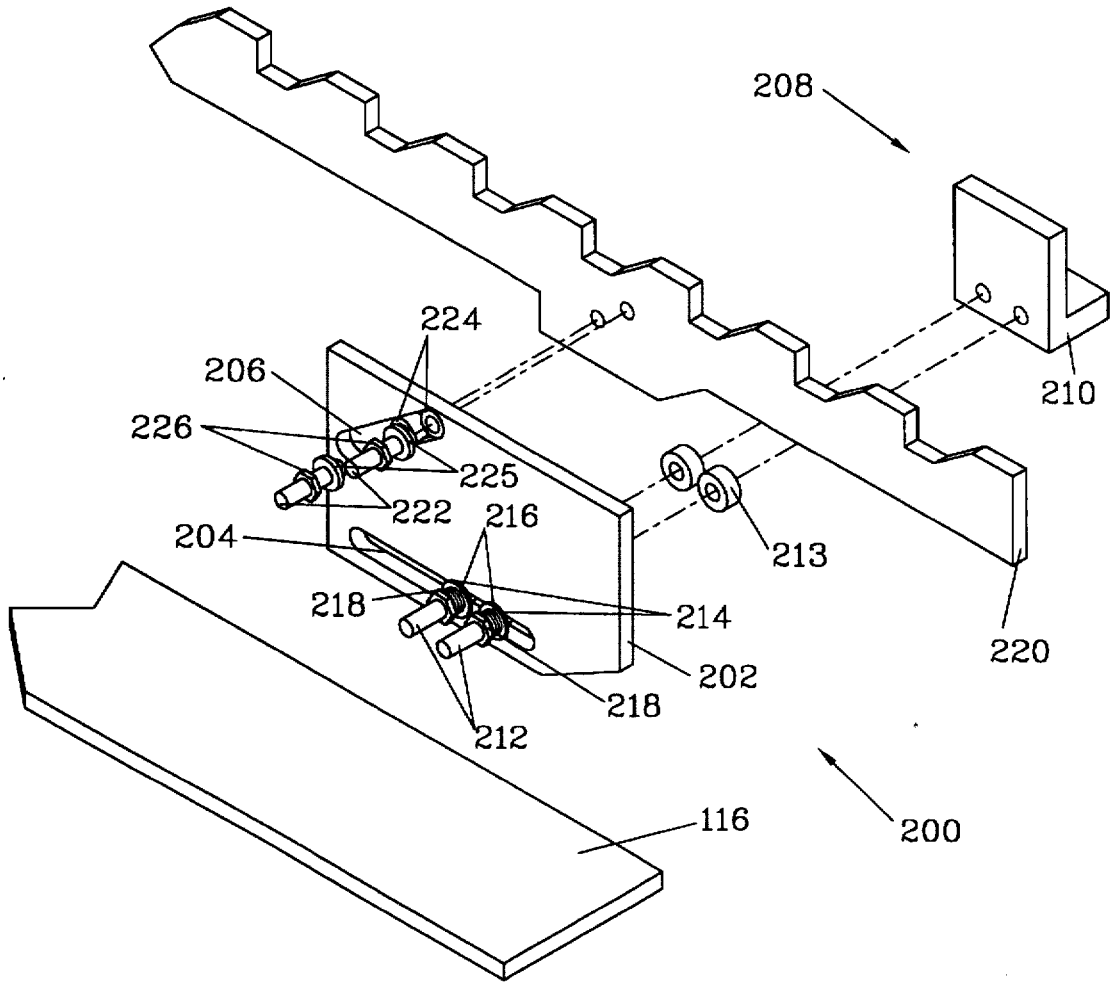
FIG. 10 is an exploded partial view of a bolt advancing mechanism which is an alternative to the bolt advancing mechanism illustrated in FIG. 3. This embodiment employs slider mechanisms having a single guide plate.

FIG. 10 is a partial view of an alternative bolt advancing mechanism showing a slider mechanism 200 which is an alternative to the slider mechanism 154 illustrated in FIGS. 3 through 5. However, the slider mechanism 200 has fewer parts, which reduces weight. The slider mechanism 200 has a guide plate 202 which in turn has a plate directing passage 204 and a carrier-directing passage 206. The slider mechanism 200 differs from the slider mechanism 154 in that a single guide plate 202 is employed rather than a pair of guide plates 156. A slider support brace 208 is provided which has a support base 210, which attaches to the magazine frame 116; a pair of support rods 212, which slidably engage the plate directing passage 204; and a pair of support rod spacers 213, through which the support rods 212 pass. The support rods 212 are threaded and, when engaged with the plate directing passage 204, are retained therein by a pair of washers 214 which in turn are maintained in rubbing contact with the guide plate 202 by rod springs 216 and rod nuts 218. The support rod spacers 213 are of sufficient length to prevent binding between the guide plate 202, the slider support brace 208, and a bolt carrier 220 which is interposed therebetween. It should be noted that if the slider support brace 208 is sufficiently low that the bolt carrier 220 will not contact it, the support rod spacers 213 can be shortened, in which case they serve primarily to provide support to the guide plate 202 to increase the rigidity of the slider mechanism 200. Similarly, while paired support rods are illustrated, a single rod could be employed, with a reduction in the rigidity of the slider mechanism 200.

The bolt carrier 220 is similar to the upper and lower bolt carriers (136 and 152) of the bolt delivery system 100, and has a pair of carrier pins 222 attached thereto which pass through the carrier-directing passage 206. The pair of carrier pins 222 are fitted with carrier pin bushings 224 which slidably engage the carrier-directing passage 206 and are of a greater length than the thickness of the guide plate 202. The carrier pin bushings 224 prevent binding of the guide plate 202 between the bolt carrier 220 and a pair of carrier pin washers 225. The carrier pin washers 225 are supported by carrier pin nuts 226 which serve to maintain the carrier pins 222 in the carrier-directing passage 206. Again, a single carrier pin could be substituted for the pair of carrier pins, however, such substitution could result in a reduction in the control of the motion of the bolt carrier 220.

When carrier pin washers are employed in the slider mechanisms, covering part of the carrier-directing passages of the guide plates, there is an increased potential for dirt and debris to accumulate in the carrier-directing passages, especially when the rock bolter is used in the underground environment of a mine. Because the ends of the carrier-directing passages will determine when movement along the plate-directing passages will occur, accumulation of dirt and debris in the carrier-directing passages may adversely affect the operation of the bolt advancing mechanism.

FIG. 11 is a partial view of another alternative bolt advancing mechanism showing a slider mechanism 230 which reduces the problem of dirt accumulation. The slider mechanism 230 is similar to the slider mechanism 154 illustrated in FIGS. 3 through 5. The slider mechanism 230 again has a pair of guide plates 232, which are mirror images of each other, each having both a plate directing passage 234 and a carrier-directing passage 236. The slider mechanism 230 differs from the slider mechanism 154 in that a carrier bolt 238 is employed which has a carrier bolt bushing 240 thereon. The carrier bolt 238 and carrier bolt bushing 240 pass through the carrier-directing passages 236 and through a bolt carrier 242, which is similar to the bolt carriers (136 and 152) of the embodiment illustrated in FIGS. 1 through 9. The carrier bolt bushing 240 slidably engages the carrier-directing passages 236, and is retained on the carrier bolt 228 by carrier bolt washers 244 and a carrier bolt nut 246. The carrier bolt bushing 240 is of sufficient length to prevent binding between the carrier bolt washers 244 and the guide plates 232.

To prevent dirt or debris from accumulating between the carrier bolt washers 244 as the ends of the carrier-directing passages 236 are approached, which could limit the range of motion of the carrier bolt 238, both ends of the carrier-directing passages 236 are provided with countersunk regions 248 on the side facing away from the bolt carrier 242. The countersunk regions 248 have sloped sides and result in a reduced thickness of the guide plates 232 at the ends of the carrier-directing passages 236, which provides for rejection of dirt or debris which accumulates in the carrier-directing passages 236. It is further preferred that the carrier bolt washers 244 be smaller than the countersunk regions 248 to facilitate elimination of dirt and debris from the carrier-directing passages 236.

While all the embodiments of means for advancing the bolt carriers through bolt-advancing cycles described above employ slider mechanisms, other types of mechanisms can be employed. FIG. 12 is a partial view of another alternative bolt advancing mechanism showing a cycling mechanism 250 which can be utilized in a bolt magazine similar to the bolt magazine 112 illustrated in FIG. 1. The cycling mechanism 250 is similar to the slider mechanism 154 in that a pair of guide plates 252 are employed. However, in the cycling mechanism 250 the guide plates 252 are affixed to the magazine frame 116 with plate brackets 254. The guide plates 252 are each provided with a guide slot 256, shaped as a parallelogram, in which rides a carrier-directing pin 258. The carrier-directing pin 258 is attached to a bolt carrier 259 which is similar to the upper and lower bolt carriers (136 and 152) of the bolt delivery system 100. Spring loaded catches 260 are provided which protrude into the guide slot 256 and are contoured to limit the translation of the carrier-directing pin 258 to the direction indicated by the arrows. The spring loaded catches 260 preferably protrude into the guide slot 256 a distance somewhat greater than half of the diameter of the carrier-directing pin 258 to assure that the movement of the carrier-directing pin 258 is limited to one direction. The guide slots 256 can be either blind or pass through the guide plates 252 as illustrated in FIG. 12. When the guide slots 256 pass through the guide plates 252, slot braces 262 are provided to increase the strength of the guide plates 252.

While guide plates have been described as the means for directing the upper and lower bolt carriers through the upper and lower carrier bolt advancing cycles, it should be appreciated that various other means, such as eccentric cams, two linear actuators with sequencing valves, or endless chains running on parallelogram-shaped paths, could be employed to provide such motion.

Figure 13:
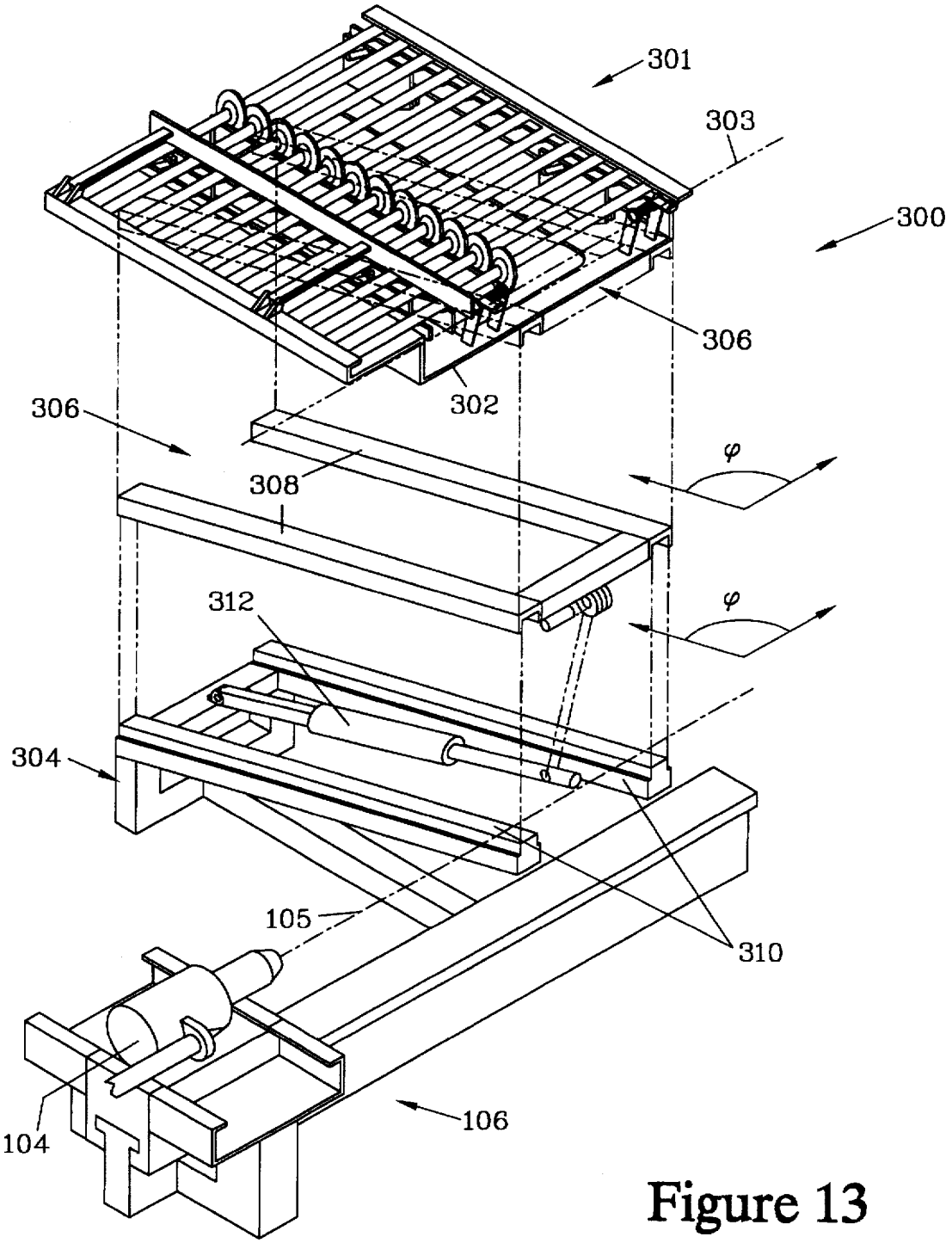
FIG. 13 is an isometric view of a bolt delivery system similar to the embodiment of FIG. 1; however, in this embodiment the bolt magazine slides rather than pivots between a work position and a park position.

FIG. 13 shows an alternative bolt delivery system 300 which employs a bolt magazine 301 which is essentially the same as the bolt magazine 112 of the bolt delivery system 100. The bolt magazine 301 of the bolt delivery system 300 has a magazine frame 302 and a bolt transfer axis 303 and is movably engaged with a magazine base 304. The magazine base 304 in turn is fixably attached to the feed shell 106.

The bolt delivery system 300 differs principally from the bolt delivery system 100 in that the magazine base 304 of the bolt delivery system 300 is slidably connected to the bolt magazine 301 rather than pivotably connected as are the magazine base 110 and bolt magazine 112 of the bolt delivery system 100. A magazine slider assembly 306 is attached to the magazine frame 302 of the bolt magazine 301. The magazine slider assembly 306 has slider tracks 308 which are inclined with respect to the bolt transfer axis 303 by an angle $\Phi$, which measures at least 90°. The magazine base 304 has magazine base tracks 310 which slidably engage the slider tracks 308. The magazine base tracks 310 are inclined with respect to the bolt driver axis 105 by the angle $\Phi$, thereby assuring that the bolt transfer axis 303 remains parallel to the bolt driver axis 105.

A linear actuator 312 is attached to the magazine base 304 and to the magazine slider assembly 306. While it is preferred for the linear actuator 312 to be a hydraulic cylinder as illustrated, it should be appreciated that alternative devices which provide a linear motion could be employed. The linear actuator 312, as it is extended or retracted, moves the bolt magazine 301 between a park position, where the bolt driver 104 and other bolt setting tools can pass thereby, and a work position, where the bolt transfer axis 303 of the bolt magazine 301 is aligned with the bolt driver axis 105 and the bolt centralizer 108 (not shown in FIG. 13). The angle $\Phi$ is preferably substantially greater than 90° so that when the linear actuator 312 is extended to move the bolt magazine 301 to the work position, a component of the movement of the bolt magazine 301 will be parallel to the feed shell 106 and in the direction of the rock surface. Similarly, as the linear actuator 312 is retracted to move the bolt magazine 301 to the park position, disengaging the bolt 102' after it has been engaged with the bolt driver 104 and the bolt centralizer 108, a component of the movement of the bolt magazine 301 is parallel to the feed shell 106 and away from the rock surface. This movement reduces the likelihood of the bolts 102 contacting the rock surface when compared with the action of the bolt delivery system 100 which pivots to bring the bolt transfer axis 114 into alignment with the bolt driver axis 105.

Figure 14:
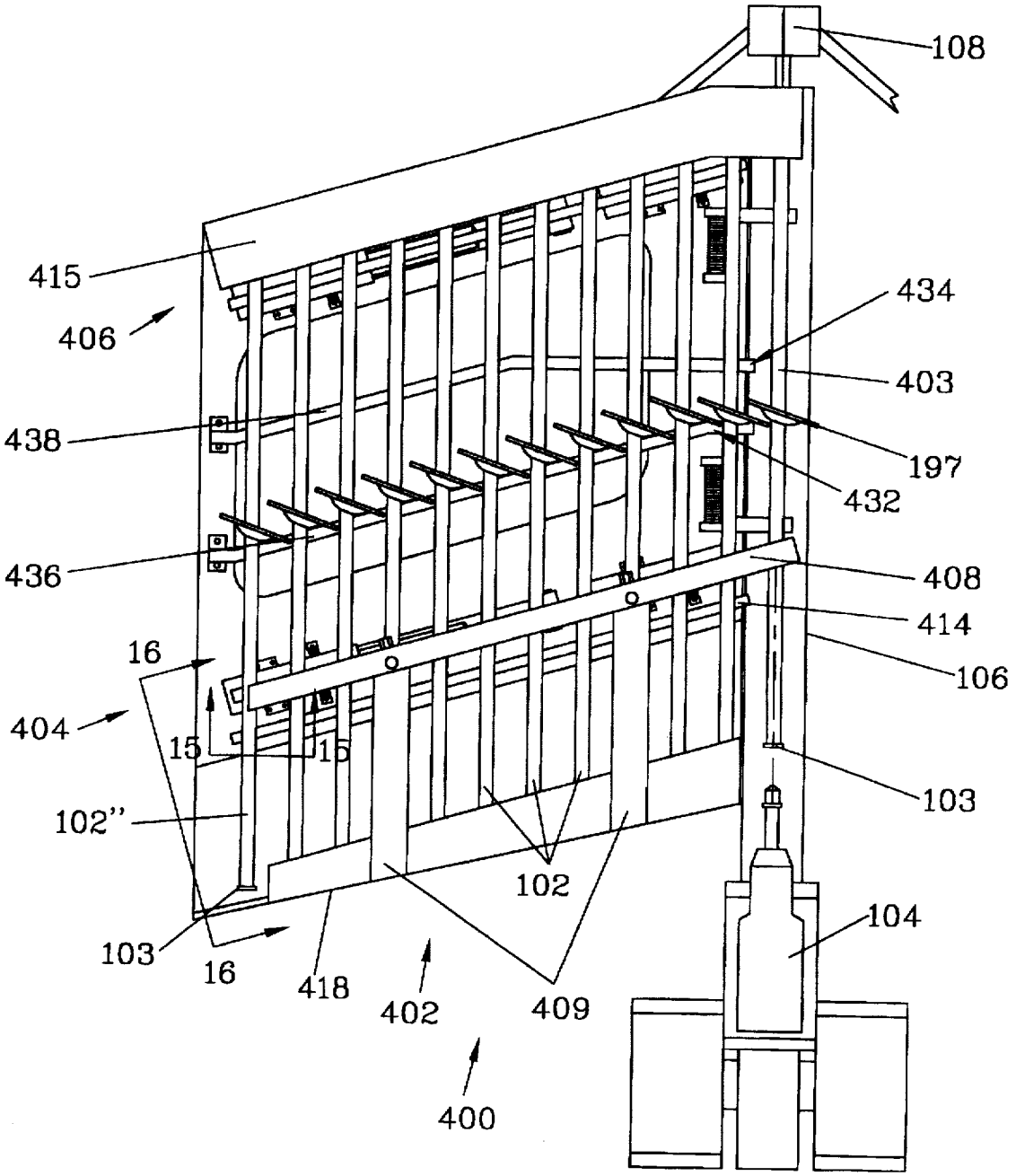
FIG. 14 is a plan view of a bolt delivery system similar to the embodiment illustrated in FIGS. 1 through 9, but differs in that the bolt magazine provides a component of motion parallel to the feed shell when advancing the bolts to the bolt transfer axis. Additionally, this embodiment is suitable for bolting where the bolts are mounted with a downward inclination.
Figure 15:
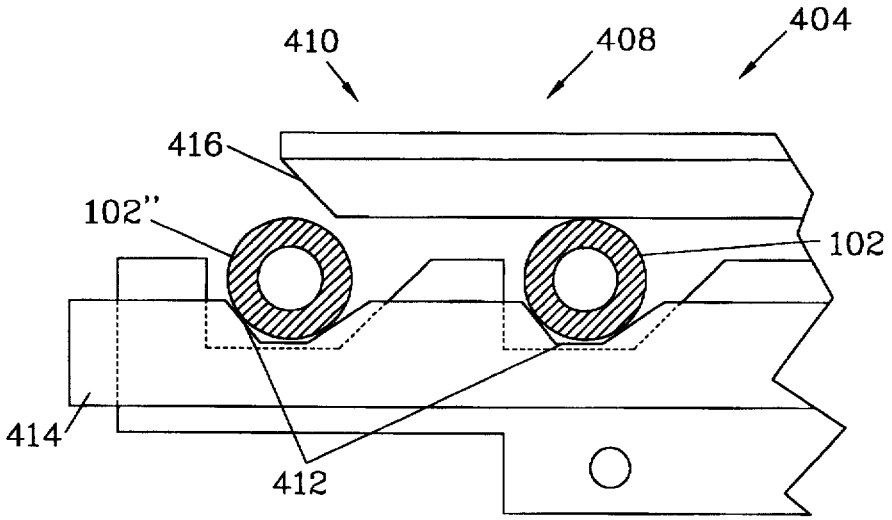
FIG. 15 is the section 15—15 of FIG. 14, showing a restraint rail ramp which is provided on a bolt restraint rail of the bolt magazine to facilitate loading individual bolts into the bolt magazine.
Figure 16:
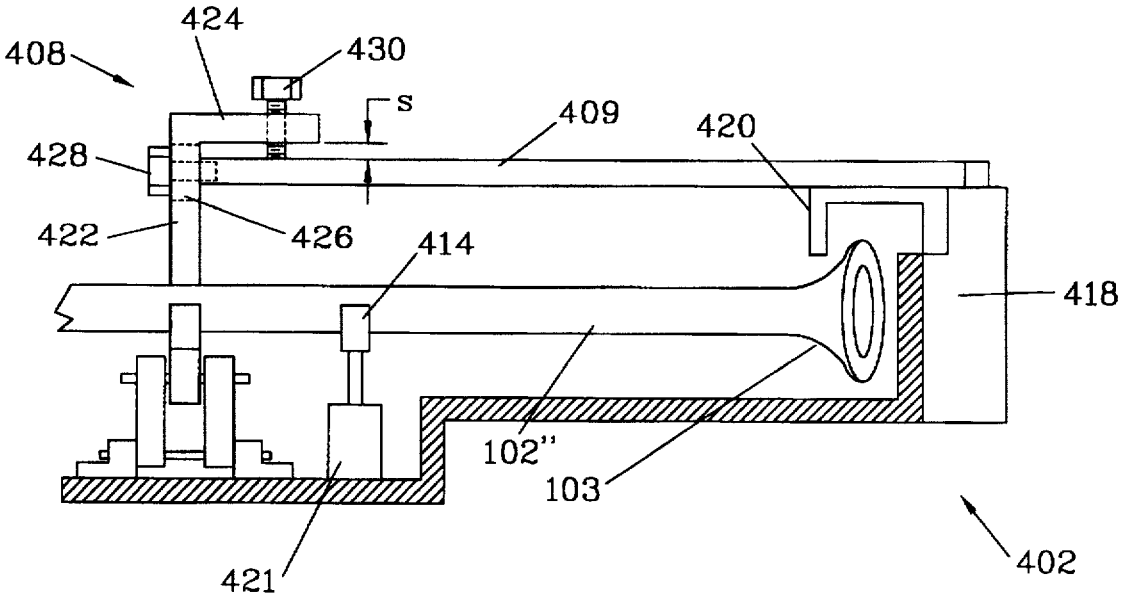
FIG. 16 is the section 16—16 of FIG. 14, showing a bolt head restraining lip which is provided on a bolt head support rail which in turn is attached to a magazine frame of the bolt magazine. The bolt head restraining lip serves to support the bolts when the bolt magazine has the bolts positioned with a downward inclination. In this embodiment the bolt heads diverge from the bolt head support rail as the bolts are advanced toward the bolt transfer axis.

FIGS. 14, 15, and 16 provide selective views of a bolt delivery system 400 which shares many common elements with the bolt delivery system 100 and the bolt delivery system 300. FIG. 14 is a plan view of the bolt delivery system 400, FIG. 15 is a view of the section 15—15 of FIG. 14, and FIG. 16 is a view of section 16—16 of FIG. 16. The bolt delivery system 400 has a bolt magazine 402 with a bolt transfer axis 403. The bolt magazine 402 differs from the bolt magazines earlier described principally in that it has a lower bolt advancing mechanism 404 and an upper bolt advancing mechanism 406 which are inclined with respect to the bolt transfer axis 403. Having the lower bolt advancing mechanism 404 and the upper bolt advancing mechanism 406 so inclined provides the bolts 102, as they are advanced toward the bolt transfer axis 403, with a component of motion parallel to the feed shell 106 and towards the rock surface into which the bolts 102 are to be set. The inclination of the bolt advancing mechanisms (404 and 406) allows the bolt magazine 402 to have a minimized cross section in a plane normal to the rock surface and significantly reduces the requirement for the rock surface to be substantially planar. The bolt magazine 402 could be either slidably or pivotably connected with respect to the feed shell 106 in the manner detailed in the description of previous embodiments.

The bolt magazine 402 also differs in that the lower bolt advancing mechanism 404 has a bolt restraint rail 408 which is rigidly mounted with respect to the bolt magazine 402 by bolt restraint rail braces 409, rather than pivoting and locking as does the bolt restraint rail 134 of the embodiment of FIG. 1. The bolt restraint rail 408 is adjustably mounted so as to provide a fixed position with respect to the bolt magazine 402, the fixed position being set to accommodate the diameter of the bolts 102 for which it is to be used.

When loading the bolt magazine 402, the bolts 102 are loaded individually, with the lower and upper bolt advancing mechanisms (404 and 406) being cycled after each bolt 102 is loaded to advance the bolts 102 incrementally. This leaves the bolt rest position most remote from the bolt transfer axis 403 open to accept a new bolt 102" being loaded therein. The bolt restraint rail 408 is foreshortened to allow access of the bolt 102". A bolt accepting region 410, illustrated in the detail section view of FIG. 15, of the bolt restraint rail 408 is created by foreshortening the bolt restraint rail 408 such that a new bolt 102" can be passed into bolt retaining notches 412 in a bolt retainer 414 of the lower bolt advancing mechanism 404. The bolt 102" is positioned into the upper bolt advancing mechanism 406 by inserting the tip of the bolt 102" so as to slide it under a bolt engaging edge 415 of the upper bolt advancing mechanism 406. The bolt 102" is then pivoted into engagement with the lower bolt advancing mechanism 404, and the lower and upper bolt advancing mechanisms (404 and 406) are cycled to advance the bolt 102". A restraint rail ramp 416 is provided on the bolt accepting region 410 of the bolt restraint rail 408 to facilitate advancing the bolt 102" by guiding the bolt 102" into the lower bolt advancing mechanism 404.

The bolt magazine 402 also differs from the earlier described embodiments in that it is suitable for bolting when the bolts are maintained with a downward inclination or for bolting into rock floor surfaces, as well as vertical and overhead rock surfaces. The bolt magazine 402 has a bolt head support rail 418 (shown in FIGS. 14 and 16) which diverges with respect to the lower bolt advancing mechanism 404, increasing the separation between the bolt head support rail 418 and the lower bolt advancing mechanism 404 as the bolt transfer axis 403 is approached. The divergence of the bolt head support rail 418 and the lower bolt advancing mechanism 404 will assure that the bolt heads 103 do not drag on the bolt head support rail 418 as the bolts 102 are advanced toward the bolt transfer axis 403, even if the bolts 102 slip relative to the lower and upper bolt advancing mechanisms (404 and 406) when the bolt delivery system 400 is positioned for setting the bolts 102 into an overhead rock surface.

The bolt head support rail 418 of the bolt delivery system 400 has a bolt head restraining lip 420 which is illustrated in the detail section view of FIG. 16. The bolt head restraining lip 420 will engage the bolt heads 103, limiting the longitudinal motion of the bolts 102 when the bolt magazine 402 has the bolts 102 positioned for placement into a rock floor surface or with a downward inclination.

The detailed section view of FIG. 16 also shows a housed spring assembly 421, two of which are employed in each of the lower bolt advancing mechanism 404 and the upper bolt advancing mechanism 406 to resiliently mount the bolt retainers 414. The housed spring assemblies 421 function in the same manner as the retainer rods 142 and retainer springs 148 employed in the bolt delivery system 100, but differ in that the housed spring assemblies 421 are less prone to accumulation of dirt and debris.

Preferably, the bolt restraint rail 408 is fabricated from an angle iron which has a first leg 422 and a second leg 424. The first leg 422 is slidably engaged with the bolt restraint rail braces 409, which are affixed with respect to the lower bolt advancing mechanism 404. The first leg 422 is provided with set bolt slots 426 through which set bolts 428 pass, the set bolts 428 engaging the bolt restraint rail braces 409. The set bolt slots 426 provide relative motion between the bolt restraint rail 408 and the bolt restraint rail braces 409 when the set bolts 428 are loosened. When tightened, the set bolts 428 rigidly secure the bolt restraint rail 408 to the bolt restraint rail braces 409. When the set bolts 428 are loosened, the position of the bolt restraint rail 408 relative to the bolt restraint rail braces 409 can be adjusted by turning positioning bolts 430. The positioning bolts 430 are threadably engaged with the second leg 424 of the bolt restraint rail 408 and engage the bolt restraint rail braces 409. As the positioning bolts 430 are turned, the separation s between the second leg 424 of the bolt restraint rail 408 and the bolt restraint rail braces 409 changes, thereby providing adjustability to the bolt restraint rail 408.

The bolt magazine 402 as illustrated is designed to also serve as a bolt plate magazine and has both a first bolt plate support rail 432 and a second bolt plate support rail 434. The pair of bolt plate support rails (432 and 434) assure that the bolt plates will be supported independent of the inclination of the bolt magazine 402. The first bolt plate support rail 432 supports the bolt plates 197 when the bolt magazine 402 has the bolts 102 positioned for placement into an overhead rock surface. The first bolt plate support rail 432 differs from the first bolt plate support rail 198 of the embodiment of FIG. 1 in that the first bolt plate support rail 432 has a first rail angled portion 436 which is inclined with respect to the bolt transfer axis 403.

The second bolt plate support rail 434 supports the bolt plates 197 when the bolt magazine 402 has the bolts 102 positioned with a downward inclination or positioned for placement into a rock floor. The second bolt plate support rail 434 has a second rail angled portion 438 which is again inclined with respect to the bolt transfer axis 403. It is preferred for the second rail angled portion 438 to be shorter than the first rail angled portion 436 of the first bolt plate support rail 432. Such a configuration of the first and second bolt plate support rails (432 and 434) will facilitate loading the bolts 102 such that the bolt plates 197 can overlap to allow for closer spacing of the bolts 102 in the bolt magazine 402. This is particularly important for bolts on which the bolt plates fit tightly, such as large diameter split-set bolts.

While the novel features of the present invention have been described in terms of particular embodiments and preferred applications, it should be appreciated by one skilled in the art that substitution of materials and modification of details obviously can be made without departing from the spirit of the invention.

What I claim is:

1. A bolt delivery system for feeding bolts which terminate in bolt heads and bolt tips, the bolt delivery system providing the bolts to a rock bolter having a feed shell along which bolt setting tools can be advanced, the bolt setting tools including a bolt driver which, when advanced on the feed shell, engages a bolt which is directed into a bolt hole by a centralizer, the bolt delivery system comprising:

a magazine base fixed with respect to the feed shell;

a bolt magazine having a bolt transfer axis, said bolt magazine having a magazine frame which is movably attached with respect to said magazine base, said bolt magazine moving between a park position, where the bolt setting tools will pass thereby when advanced on the feed shell, and a work position, where said bolt magazine intersects the path of advancement of the bolt driver when the bolt driver is advanced on the feed shell such that the bolt driver will engage a bolt positioned on said bolt transfer axis and advance the bolt so positioned into the centralizer;

means for moving said bolt magazine between said work position and said park position;

a linear incremental bolt advancing mechanism connected to said magazine frame, said linear incremental bolt advancing mechanism serving to advance the bolts to said bolt transfer axis;

a first bolt-embracing arm pivotably mounted to said magazine frame, said first bolt-embracing arm being rotatable from a bolt engaging position, where said first bolt-embracing arm engages a bolt positioned on said bolt transfer axis, to a bolt-passing position, where said first bolt embracing arm can be moved past a bolt positioned on said bolt transfer axis; and resilient means for biasing said first bolt-embracing arm towards said bolt-engaging position.

2. The bolt delivery system of claim 1 wherein the bolts have a diameter and further wherein said linear incremental bolt advancing mechanism further comprises:

a lower bolt advancing mechanism having, a lower bolt retainer mounted to said magazine frame, a bolt restraint rail which is mounted to said magazine frame, said bolt restraint rail being mounted with respect to said magazine frame to provide a bolt-engaging position, where said bolt restraint rail is in a spaced apart relationship to said lower bolt retainer such that a separation distance between said bolt restraint rail and said lower bolt retainer will maintain engagement of the bolts with said bolt restraint rail and said lower bolt retainer, lower bolt retaining notches which locally increase the separation between said lower bolt retainer and said bolt restraint rail providing rest positions periodically spaced at a distance d, said lower bolt retaining notches providing lateral support for the bolts while maintaining engagement of the bolts with both said lower bolt retainer and said bolt restraint rail, means for accommodating a variable separation distance between said lower bolt retainer and said bolt restraint rail to allow the bolts to be incrementally advanced toward said bolt transfer axis, a lower bolt carrier having lower carrier bolt-engaging surfaces for engaging the bolts, said lower bolt carrier being coupled with said magazine frame, and means for moving said lower bolt carrier through a lower carrier bolt advancing cycle wherein said lower bolt carrier is raised from a lower carrier non bolt contacting position to bring said lower carrier bolt-engaging surfaces into engagement with the bolts, translated to advance the bolts towards said bolt transfer axis, lowered to disengage said lower carrier bolt-engaging surfaces from the bolts, and translated back to said lower carrier non bolt contacting position;

an upper bolt advancing mechanism having, an upper bolt retainer mounted to said magazine frame, a bolt-engaging edge affixed with respect to said magazine frame, said bolt-engaging edge being in a spaced apart relationship to said upper bolt retainer such that a separation distance between said bolt-engaging edge and said upper bolt retainer will maintain engagement the bolts with both said bolt-engaging edge and said upper bolt retainer, upper bolt retaining notches which locally increase the separation between said upper bolt retainer and said bolt-engaging edge providing rest positions periodically spaced at said distance d, said upper bolt retaining notches providing lateral support for the bolts while maintaining engagement of the bolts with both said upper bolt retainer and said bolt-engaging edge, means for accommodating a variable separation distance between said upper bolt retainer and said bolt-engaging edge to allow the bolts to be incrementally advanced toward said bolt transfer axis, an upper bolt carrier having upper carrier bolt-engaging surfaces for engaging the bolts, said upper bolt carrier being coupled with said magazine frame, means for moving said upper bolt carrier through an upper carrier bolt advancing cycle wherein said upper bolt carrier is raised from an upper carrier non bolt contacting position to bring said upper carrier bolt-engaging surfaces into engagement with the bolts, translated to advance the bolts towards said bolt transfer axis, lowered to disengage said upper carrier bolt-engaging surfaces from the bolts, and translated back to said upper carrier non bolt contacting position; and still further wherein said lower bolt advancing mechanism is in closer proximity to the bolt heads than said upper bolt advancing mechanism.

3. The bolt delivery system of claim 2 further comprising:

an end cap attached to said magazine frame in a spaced apart relationship to the bolt tips and having said bolt-engaging edge attached thereto.

4. The bolt delivery system of claim 2 further comprising:

a second bolt-embracing arm pivotably mounted to said magazine frame, said second bolt-embracing arm being rotatable from a bolt-engaging position, where said second bolt-embracing arm engages a bolt positioned on said bolt transfer axis, to a bolt-passing position, where said second bolt-embracing arm can be moved past a bolt positioned on said bolt transfer axis; and resilient means for biasing said second bolt-embracing arm towards said bolt-engaging position; and further wherein, said first bolt-embracing arm, said bolt restraint rail, and at least one of said lower bolt retainer and said lower bolt carrier, in combination, support the bolt on said bolt transfer axis by engaging the bolt, and said second bolt-embracing arm, said bolt engaging-edge, and at least one of said upper bolt retainer and said upper bolt carrier, in combination, support the bolt on said bolt transfer axis by engaging the bolt.

5. The bolt delivery system of claim 4 wherein said bolt magazine serves as a bolt and bolt plate magazine for housing the bolts and bolt plates which the bolts pass through, said bolt magazine further comprising:

a first bolt plate support rail attached to said magazine frame and positioned to engage and stabilize the bolt plates as the bolts are advanced in said bolt magazine; and a bolt head support rail attached to said magazine frame on which the heads of the bolts ride as the bolts are advanced in said bolt magazine.

6. The bolt delivery system of claim 5 wherein said bolt magazine further comprises:

a second bolt plate support rail attached to said magazine frame and positioned to engage and stabilize the bolt plates as the bolts are advanced in said bolt magazine, said second bolt plate support rail being positioned such that the bolt plates reside between said first bolt plate support rail and said second bolt plate support rail; and a bolt head restraining lip provided on said bolt head support rail, said bolt head restraining lip being configured to engage the bolt heads to limit longitudinal motion of the bolts.

7. The bolt delivery system of claim 5 further comprising:

means for stopping advancement of the bolt driver prior to engagement with said bolt magazine when said bolt magazine is in said work position.

8. The bolt delivery system of claim 7 wherein said bolt magazine pivotably engages said magazine base, and wherein said means for moving said bolt magazine between said work position and said park position provide a pivoting motion.

9. The bolt delivery system of claim 8 wherein said means for moving said bolt magazine between said work position and said park position further comprises:

a linear actuator having a first end which pivotably engages said magazine base and a second end which pivotably engages said magazine frame.

10. The bolt delivery system of claim 7 wherein said bolt magazine slidably engages said magazine base, and wherein said means for moving said bolt magazine between said work position and said park position provide a sliding means.

11. The bolt delivery system of claim 10 wherein said sliding means further comprises:

a magazine slider assembly attached to said bolt magazine, said magazine slider assembly having slider tracks;

magazine base tracks attached to said magazine base, said magazine base tracks being slidably engaged with said slider tracks; and a linear actuator attached to said magazine base and to said magazine slider assembly.

12. The bolt delivery system of claim 11 wherein said slider tracks are inclined an angle Φ to said bolt transfer axis and said magazine base tracks are inclined at the angle Φ to said bolt driver axis.

13. The bolt delivery system of claim 5 wherein said bolt magazine maintains the bolts in a linear array which defines a bolt delivery plane and further wherein said means for moving said upper bolt carrier through said upper carrier bolt advancing cycle and said means for moving said lower bolt carrier through said lower carrier bolt advancing cycle further comprise:

a pair of slider mechanisms connected to each of said upper bolt carrier and said lower bolt carrier, each of said slider mechanisms further comprising:

at least one guide plate, said at least one guide plate having a plate-directing passage and a carrier-directing passage therethrough, a brace attached to said magazine frame and slidably engaging said plate-directing passage, said plate-directing passage being so configured as to allow said at least one guide plate to move along a path which is parallel to said bolt delivery plane, at least one bolt carrier pin attached to each of said upper bolt carrier and said lower bolt carrier, each of said at least one bolt-carrier pins slidably engaging said carrier-directing passage, said carrier-directing passage being so configured as to allow said at least one bolt carrier pin to move along a path which is inclined with respect to said bolt delivery plane, and a braking means which frictionally engages said at least one guide plate; and advancing actuators connected to said magazine frame and to each of said upper bolt carrier and said lower bolt carrier, said advancing actuators driving said upper bolt carrier through said upper carrier bolt advancing cycle and said lower bolt carrier through said lower carrier bolt advancing cycle.

14. The bolt delivery system of claim 5 wherein said means for moving said upper bolt carrier through said upper carrier bolt advancing cycle and said means for moving said lower bolt carrier through said lower carrier bolt advancing cycle further comprise:

a pair of cycling mechanisms connected to each of said upper bolt carrier and said lower bolt carrier, each of said cycling mechanisms further comprising:

a pair of guide plates attached to said magazine frame, each of said guide plates having a guide slot therein, said guide slot being parallelogram shaped, a carrier-directing pin attached to one of said upper bolt carrier and said lower bolt carrier, said carrier-directing pin riding in said guide slot, each of said guide plates further having a pair of spring loaded catches which protrude into said guide slot, said spring loaded catches limiting the translation of said carrier-directing pin; and advancing actuators connected to said magazine frame and to each of said upper bolt carrier and said lower bolt carrier, said advancing actuators driving said upper bolt carrier through said upper carrier bolt advancing cycle and said lower bolt carrier through said lower carrier bolt advancing cycle.

15. The bolt delivery system of claim 2 wherein said lower bolt carrier and said upper bolt carrier provide the bolts a component of motion which is parallel to the feed shell.

16. The bolt delivery system of claim 15 further comprising:

an end cap attached to said magazine frame in a spaced apart relationship to the bolt tips and having said bolt-engaging edge attached thereto.

17. The bolt delivery system 15 further comprising:

a second bolt-embracing arm pivotably mounted to said magazine frame, said second bolt-embracing arm being rotatable from a bolt-engaging position, where said second bolt-embracing arm engages a bolt positioned on said bolt transfer axis, to a bolt-passing position, where said second bolt-embracing arm can be moved past a bolt positioned on said bolt transfer axis; and resilient means for biasing said second bolt-embracing arm towards said bolt-engaging position; and further wherein, said first bolt-embracing arm, said bolt restraint rail, and at least one of said lower bolt retainer and said lower bolt carrier, in combination support the bolt on said bolt transfer axis by engaging the bolt, and said second bolt-embracing arm, said bolt engaging-edge, and at least one of said upper bolt retainer and said upper bolt, carrier, in combination support the bolt on said bolt transfer axis by engaging the bolt.

18. The bolt delivery system of claim 17 wherein said bolt magazine serves as a bolt and bolt plate magazine for housing the bolts and bolt plates which the bolts pass through, said bolt magazine further comprising:

a first bolt plate support rail attached to said magazine frame and positioned to engage and stabilize the bolt plates as the bolts are advanced in said bolt magazine; and a bolt head support rail attached to said magazine frame on which the heads of the bolts ride as the bolts are advanced in said bolt magazine.

19. The bolt delivery system of claim 18 wherein said bolt magazine further comprises:

a second bolt plate support rail attached to said magazine frame and positioned to engage and stabilize the bolt plates as the bolts are advanced in said bolt magazine, said second bolt plate support rail being positioned such that the bolt plates reside between said first bolt plate support rail and said second bolt plate support rail; and a bolt head restraining lip provided on said bolt head support rail, said bolt head restraining lip being configured to engage the bolt heads to limit longitudinal motion of the bolts.

20. The bolt delivery system of claim 19 further comprising:

means for stopping advancement of the bolt driver prior to engagement with said bolt magazine when said bolt magazine is in said work position.

21. The bolt delivery system of claim 20 wherein said bolt magazine pivotably engages said magazine base, and wherein said means for moving said bolt magazine between said work position and said park position provide a pivoting motion.

22. The bolt delivery system of claim 1 wherein the advancement of the bolts by said linear incremental bolt advancing mechanism provides the bolts a component of motion which is parallel to the feed shell.

* * * * *